US007710338B2

(12) United States Patent
Fujishima et al.

(10) Patent No.: US 7,710,338 B2
(45) Date of Patent: May 4, 2010

(54) SLOT ANTENNA APPARATUS ELIMINATING UNSTABLE RADIATION DUE TO GROUNDING STRUCTURE

(75) Inventors: Tomoyasu Fujishima, Kanagawa (JP); Hiroshi Kanno, Osaka (JP)

(73) Assignee: Panasonic Corporation, Osaka (JP)

( * ) Notice: Subject to any disclaimer, the term of this patent is extended or adjusted under 35 U.S.C. 154(b) by 222 days.

(21) Appl. No.: 12/113,407

(22) Filed: May 1, 2008

(65) Prior Publication Data

US 2009/0066596 A1 Mar. 12, 2009

(30) Foreign Application Priority Data

May 8, 2007 (JP) ..... 2007-123205

(51) Int. Cl.
*H01Q 13/10* (2006.01)

(52) U.S. Cl. ..... 343/767; 343/770; 343/700 MS; 343/859

(58) Field of Classification Search ..... 343/767, 343/770, 700 MS, 850, 859
See application file for complete search history.

(56) References Cited

U.S. PATENT DOCUMENTS

| | | | | |
|---|---|---|---|---|
| 5,376,943 | A * | 12/1994 | Blunden et al. | 343/795 |
| 6,864,848 | B2 * | 3/2005 | Sievenpiper | 343/767 |
| 7,397,439 | B2 | 7/2008 | Kanno et al. | |
| 2008/0278390 | A1 * | 11/2008 | Massey et al. | 343/722 |
| 2008/0316118 | A1 * | 12/2008 | Puente Baliarda et al. | 343/702 |

FOREIGN PATENT DOCUMENTS

| | | |
|---|---|---|
| JP | 2004-336328 | 11/2004 |
| JP | 4050307 | 12/2007 |

OTHER PUBLICATIONS

L. Zhu et al., "A Novel Broadband Microstrip-Fed Wide Slot Antenna With Double Rejection Zeros," IEEE Antennas and Wireless Propagation Letters, vol. 2, 2003, pp. 194-196.

T. Fukazawa et al., "Impedance Measurement of the Antenna on the Portable Telephone using Fiber-Optics," Proceeding of the 2003 IEICE General Conference, the Institute of Electronics, Information and Communication Engineers (IEICE), B-1-206, 2003, p. 206 (with English translation).

* cited by examiner

*Primary Examiner*—Douglas W Owens
*Assistant Examiner*—Dieu Hien T Duong
(74) *Attorney, Agent, or Firm*—Wenderoth, Lind & Ponack, LLP.

(57) ABSTRACT

A slot antenna apparatus includes a grounding conductor having an outer edge including a first portion and a second portion, a one-end-opened slot formed in the grounding conductor along a radiation direction such that an open end is provided at a center of the first portion, a first feed line intersecting with the slot to feed radio-frequency signals, a second feed line connected to an external circuit, and a signal processing circuit including active elements and connected between the first and second feed lines and connected to the grounding conductor. The grounding conductor is configured to be symmetric about an axis parallel to the radiation direction and passing through the slot, and is provided with a grounding terminal on the axis of symmetry at the second portion. The grounding terminal is to be connected to a ground of the external circuit.

5 Claims, 26 Drawing Sheets

SLOT ANTENNA APPARATUS ELIMINATING UNSTABLE RADIATION DUE TO GROUNDING STRUCTURE

BACKGROUND OF THE INVENTION

1. Field of the Invention

The present invention relates to a slot antenna apparatus for transmitting and receiving analog radio-frequency signals or digital signals in a microwave band, a millimeter-wave band, etc. More particularly, the present invention relates to a slot antenna apparatus that eliminates unstable radiation due to its grounding structure.

2. Description of the Related Art

A wireless device operable in a much wider band than that of prior art devices is required for the following two reasons. As the first reason, it is intended to implement a novel short-range wireless communication system with the authorization of use of a very wide frequency band, i.e., an ultra-wideband (UWB) wireless communication system. As the second reason, it is intended to utilize a variety of communication systems each using different frequencies, by means of one terminal.

For example, when converting a frequency band into a fractional bandwidth being normalized by a center frequency "f0" of an operating band, a frequency band from 3.1 GHz to 10.6 GHz authorized for UWB in U.S.A. corresponds to a value of 109.5%, indicating a very wide band. On the other hand, in cases of a patch antenna and a one-half effective wavelength slot antenna which are known as basic antennas, the operating bands converted to fractional bandwidths are less than 5% and less than 10%, respectively, and thus, such antennas cannot achieve a wideband property such as that of UWB. For example, referring to the frequency bands currently used for wireless communications in the world, a fractional bandwidth to the extent of 30% should be achieved in order to cover bands from the 1.8 GHz band to the 2.4 GHz band with one same antenna, and similarly, a fractional bandwidth to the extent of 90% should be achieved in order to simultaneously cover the 800 MHz band and the 2 GHz band with one same antenna. Furthermore, in order to simultaneously cover bands from the 800 MHz band to the 2.4 GHz band, a fractional bandwidth of 100% or more is required. The more the number of systems simultaneously handled by one same terminal increases, thus resulting in the extension of a frequency band to be covered, the more a wideband antenna with small size is required to be implemented.

Moreover, it is considered to apply a balanced line with high noise immunity and operable in a low voltage, to a feed line of an antenna designed for a high-speed communication system, and to transmission lines for use in a circuit of high-frequency devices. While a conventional unbalanced line is formed of a planar grounding conductor and one strip-shaped signal line conductor, a balanced line is formed of a planar grounding conductor and two parallel strip-shaped signal line conductors. In the balanced line, a signal is transmitted as a potential difference between two signal lines provided in one same plane on a dielectric substrate, thus requiring a specific structure and circuit of input and output terminals. In order to design high-frequency devices suitable for high-speed communication systems, a balanced line can be applied to a feed line of an antenna, to active devices connected to feed lines in use, such as antenna switches or amplifiers, or to passive devices, such as bandpass filters.

A one-end-opened one-quarter effective wavelength slot antenna is one of the most basic planar antennas, and a schematic view of this antenna is shown in FIGS. 34A, 34B, and 34C (hereinafter, referred to as a "first prior art example"). FIG. 34A is a schematic top view showing a structure of a typical one-quarter effective wavelength slot antenna (showing a grounding conductor 103 on a backside in phantom view), FIG. 34B is a schematic cross-sectional view of the slot antenna in FIG. 34A, and FIG. 34C is a schematic view showing a backside structure of the slot antenna in FIG. 34A in phantom view. As shown in FIGS. 34A, 34B, and 34C, a feed line 113 is provided on a front-side of a dielectric substrate 101, and a notch with a width "Ws" and a length "Ls" is formed in a depth direction 109*a* from an outer edge 105*a* of an infinite grounding conductor 103 provided on a backside thereof. The notch operates as a slot resonator 111, one of its ends is opened at an open end 107. The slot 111 is a circuit element which is obtained by completely removing a conductor in thickness direction, in a partial region of the grounding conductor 103, and which resonates near a frequency "fs" at which one-quarter of the effective wavelength is equivalent to the slot length "Ls". The feed line 113 formed in a width direction 109*b* intersects with the slot 111 at a portion thereof, and electromagnetically excites the slot 111. A connection to an external circuit is established through an input terminal. It is noted that according to common practice, a distance "Lm" of the feed line 113 from its open-ended termination point 119 to the slot 111 is set to the extent of one-quarter effective wavelength at the frequency "fs", so as to achieve input impedance matching. Further, it is noted that according to common practice, a line width "W1" is designed based on a thickness "H" of the substrate and a permittivity of the substrate, such that the characteristic impedance of the feed line 113 is set to 50Ω.

As shown in FIGS. 35A, 35B, and 35C, Patent Document 1 discloses a structure for operating the one-quarter effective wavelength slot antenna shown in the first prior art example, at a plurality of resonant frequencies (hereinafter, referred to as a "second prior art example"). A slot 111 has a slot length "Ls", and includes a capacitor 16 so as to connect points 16*a* and 16*b* each located a distance "Ls2" away from an open end. When the antenna is excited at a plurality of resonant frequencies at a feeding point 15, the antenna operates with different slot lengths "Ls" and "Ls2" as shown in FIGS. 35B and 35C, and thus the bandwidth can be extended. However, according to the frequency characteristics shown in Patent Document 1, it is not enough to obtain a currently required ultra-wideband characteristics.

Non-Patent Document 1 discloses a method of operating a slot resonator in a wideband, which is short-circuited at both ends of a slot, and is of a one-half effective wavelength slot antenna (hereinafter, referred to as the "third prior art example"). FIG. 36 is a schematic top view showing a structure of a slot antenna described in Non-Patent Document 1. Referring to FIG. 36, a grounding conductor 103 and a slot 111 on a backside of a substrate are shown in phantom view. The slot 111 is formed in the grounding conductor 103, such that the slot 111 has a certain width "Ws", and a length "Ls" equivalent to one-half effective wavelength, and such that the slot 111 is coupled to a feed line 113 at a position 51*a* which is offset by a distance "d" from the center of the slot 111. According to prior art methods for matching input impedance of a slot antenna, a method has been used in which for exciting the slot 111, the feed line 113 intersects with the slot 111 at a position on the feed line 113 apart from an open-ended termination point 119 by one-quarter effective wavelength at a frequency "fs". However, as shown in FIG. 36, in the third prior art example, a region extending over a distance "Lind" from the open-ended termination point 119 of the feed line 113 is replaced by an inductive region 121 which is a transmission line with a characteristic impedance higher than 50Ω, and that inductive region 121 is coupled to the slot 111 at substantially the center of the inductive region 121 (i.e., in FIG. 36, "t1" and "t2" are substantially equal to each other). In this case, a width "W2" of the inductive region 121 is set to a certain width narrower than the width of the feed line 113, the length "Lind" of the inductive region 121 is set to one-quarter effective wavelength at a center frequency "f0" of an operating band, and the inductive region 121 operates as a one-quarter wavelength resonator different from the slot resonator. As a result, an equivalent circuit structure includes two resonators, which is increased from one resonator that is included in a typical slot antenna, and a double-resonance operation is achieved by coupling the resonators resonating at frequencies close to each other. In an example shown in FIG. 2(*b*) of Non-Patent Document 1, a good reflection impedance characteristic of −10 dB or less is achieved at a fractional bandwidth of 32% (near 4.1 GHz to near 5.7 GHz). As shown in comparison of actual measurement results of reflection characteristics versus frequency in FIG. 4 of Non-Patent Document 1, the fractional bandwidth of the antenna of the third prior art example is much wider than a fractional bandwidth of 9% of a typical slot antenna fabricated under conditions using the same substrate.

FIG. 37 is a schematic view showing a method for measuring a mobile phone antenna described in Non-Patent Document 2 (hereinafter, referred to as the "fourth prior art example"). When measuring a mobile phone 2 under test by a network analyzer 1, in conventional technique, they are connected through a radio-frequency (RF) unbalanced feed circuit, such as a radio-frequency cable. However, Non-Patent Document 2 reported that when using an unbalanced feed circuit to feed a small-sized communication terminal having a grounding conductor of a finite area available for antenna operation, an unbalanced grounding conductor current occurring in the grounding conductor flows back into a grounding conductor of a feed circuit in a measuring apparatus, thus affecting the measurement accuracy itself of radiation characteristics and impedance characteristics. Hence, as shown in FIG. 37, Non-Patent Document 2 discloses that instead of feeding by using a radio-frequency unbalanced feed circuit, a photodiode (PD) 2*a* and a light-emitting diode (LD) 2*c* are provided in the mobile phone 2 as an input terminal and an output terminal, and further, a light-emitting diode 4 and a photodiode 5 are provided also in the network analyzer 1, and they are connected by optical fibers (shown by dotted lines in FIG. 37). A signal S1 outputted from the network analyzer 1, and a signal S2 reflected from a feeding point S3 of an antenna 3 and inputted to the network analyzer 1 are transmitted by different optical fibers. An inputted wave and a reflected wave to/from the antenna 3 are separated by a circulator 2*b*. The use of optical fibers upon feeding enables to isolate a grounding conductor from a feed system in the mobile phone 2, thus achieving a measurement without adverse effects of an unbalanced grounding conductor current in a small-sized antenna.

Prior art documents related to the present invention are as follows:

(1) Patent Document 1: Japanese Patent laid-open Publication No. 2004-336328;

(2) Non-Patent Document 1: L. Zhu, et al., "A Novel Broadband Microstrip-Fed Wide Slot Antenna With Double Rejection Zeros", IEEE Antennas and Wireless Propagation Letters, Vol. 2, pp. 194-196, 2003; and (3) Non-Patent Document 2: Fukazawa, et al., FUKAZAWA et al., "Impedance Measurement of the Antenna on the Portable Telephone using Fiber-Optics", Proceedings of the 2003 IEICE (The Institute of Electronics, Information and Communication Engineers) General Conference, B-1-206, p. 206, 2003.

As discussed above, sufficient wide band operation has not been achieved in the prior art slot antennas. Additionally, even if the wideband property can be achieved with a small-sized configuration, radiation characteristics and input impedance characteristics are unstable depending on a connection between an antenna and an external unbalanced feed circuit. Thus, it is hard to determine characteristics to be exhibited when the antenna is mounted on a wireless communication terminal apparatus.

First of all, in the case of the typical one-end-opened slot antenna with only one resonator in its configuration as in the first prior art example, the antenna can operate in a resonant mode within only a limited band, and thus, a frequency band, where a good reflection impedance characteristic can be achieved, is limited to a fractional bandwidth to the extent of a little less than 10%.

In the second prior art example, although a wideband operation is achieved by incorporating the capacitive reactance element into the slot, it can be readily noticed that additional components such as the chip capacitor are required, and the characteristics of the antenna vary depending on variations in characteristics of the newly incorporated additional components. Further, according to the examples disclosed in FIGS. 14 and 18 of Patent Document 1, it is hard to achieve characteristics of input impedance matching with low reflection across an ultra-wideband.

In the third prior art example, the fractional bandwidth characteristic is limited to the extent of 35%. Further, as compared to the antennas of the first and second prior art examples with one-end-opened slot resonators which are of one-quarter effective wavelength resonators, it is disadvantageous in reducing size to use the slot resonator which is short-circuited at both ends and is of the one-half effective wavelength resonator.

Accordingly, even if incorporating the principle of the double-resonance operation according to the third prior art example when designing the one-quarter effective wavelength slot antenna according to the first or second prior art example, the unbalanced grounding conductor current flows back into the grounding conductor of the unbalanced feed circuit connected to the antenna during the antenna operation, as pointed out in Non-Patent Document 2. The radiation characteristics and input impedance characteristics of the antenna vary depending on the shape of the unbalanced feed circuit through which the unbalanced grounding conductor current flows, for example, depending on a length of a coaxial cable which is connected to the antenna to determine the characteristics. Particularly, the radiation characteristics severely vary depending on the conditions of an external circuit.

SUMMARY OF THE INVENTION

An object of the present invention is to solve the above-described problems, and to provide a small-sized wideband slot antenna apparatus which is configured based on a one-end-opened slot antenna, and which can operate in a wider band than prior art apparatuses, and eliminates factors causing the radiation to be unstable due to the grounding structure (i.e., a connection with an external circuit), thus achieving stable operation.

According to a slot antenna apparatus of an aspect of the present invention, the slot antenna apparatus is provided with: a grounding conductor, having an outer edge including a first portion facing a radiation direction, and a second portion other than the first portion; a one-end-opened slot formed in the grounding conductor along the radiation direction such that an open end is provided at a center of the first portion of the outer edge of the grounding conductor; a first feed line including a strip conductor close to the grounding conductor and intersecting with the slot at least a part thereof to feed radio-frequency signals to the slot; a second feed line including a strip conductor close to the grounding conductor and connected to an external circuit; and a signal processing circuit connected between the first and second feed lines, and connected to the grounding conductor, the signal processing circuit including active elements and processing radio-frequency signals to be transmitted and received. The grounding conductor is configured to be symmetric about an axis parallel to the radiation direction and passing through the slot, and the grounding conductor is provided with a grounding terminal on the axis of symmetry of the grounding conductor, at the second portion of the outer edge of the grounding conductor, and the grounding terminal is to be connected to a ground of the external circuit. As a result of providing the grounding terminal on the axis of symmetry of the grounding conductor, the grounding terminal has a higher input and output impedance than an impedance in an unbalanced mode of the grounding conductor.

In the above-described slot antenna apparatus, the first feed line is terminated at an open end. A region of the first feed line, which extends from the open end over a length of one-quarter effective wavelength at a center frequency of the operating band, is configured as an inductive region with a characteristic impedance higher than 50Ω. The first feed line intersects with the slot at substantially a center of the inductive region.

Moreover, in the above-described slot antenna apparatus, the first feed line is branched at a first point near the slot into a group of branch lines including at least two branch lines, and at least two branch lines among the group of branch lines are connected to each other at a second point near the slot and different from the first point, thus forming at least one loop wiring line on the first feed line. A maximum value of respective loop lengths of the at least one loop wiring line is set to a length less than one effective wavelength at an upper limit frequency of an operating band. Branch lengths of all of the branch lines terminated at an open end without forming a loop wiring line are less than one-quarter effective wavelength at the upper limit frequency of the operating band.

Further, in the above-described slot antenna apparatus, each loop wiring line intersects with boundaries between the slot and the grounding conductor, and the slot is excited at two or more points at which the boundaries intersect with the loop wiring line and which have different distances from the open end of the slot.

Furthermore, in the above-described slot antenna apparatus, the grounding conductor is configured such that at the first portion of the outer edge of the grounding conductor, distances from the open end of the slot to both ends of the first portion of the outer edge are respectively set to a length greater than or equal to one-quarter effective wavelength at a resonant frequency of the slot, and thus the grounding conductor operates at a frequency lower than the resonant frequency of the slot.

According to the wideband slot antenna apparatus of the present invention, it can not only achieve a wideband operation which is hard to achieve by prior art slot antennas, but also eliminate unstable radiation characteristics caused by a connection with an external unbalanced feed circuit connected to the antenna, thus achieving stable operation.

BRIEF DESCRIPTION OF THE DRAWINGS

Various objects, features, and advantages of the present invention will be disclosed as preferred embodiments which are described below with reference to the accompanying drawings.

DETAILED DESCRIPTION OF THE PREFERRED EMBODIMENTS

Figure 1:
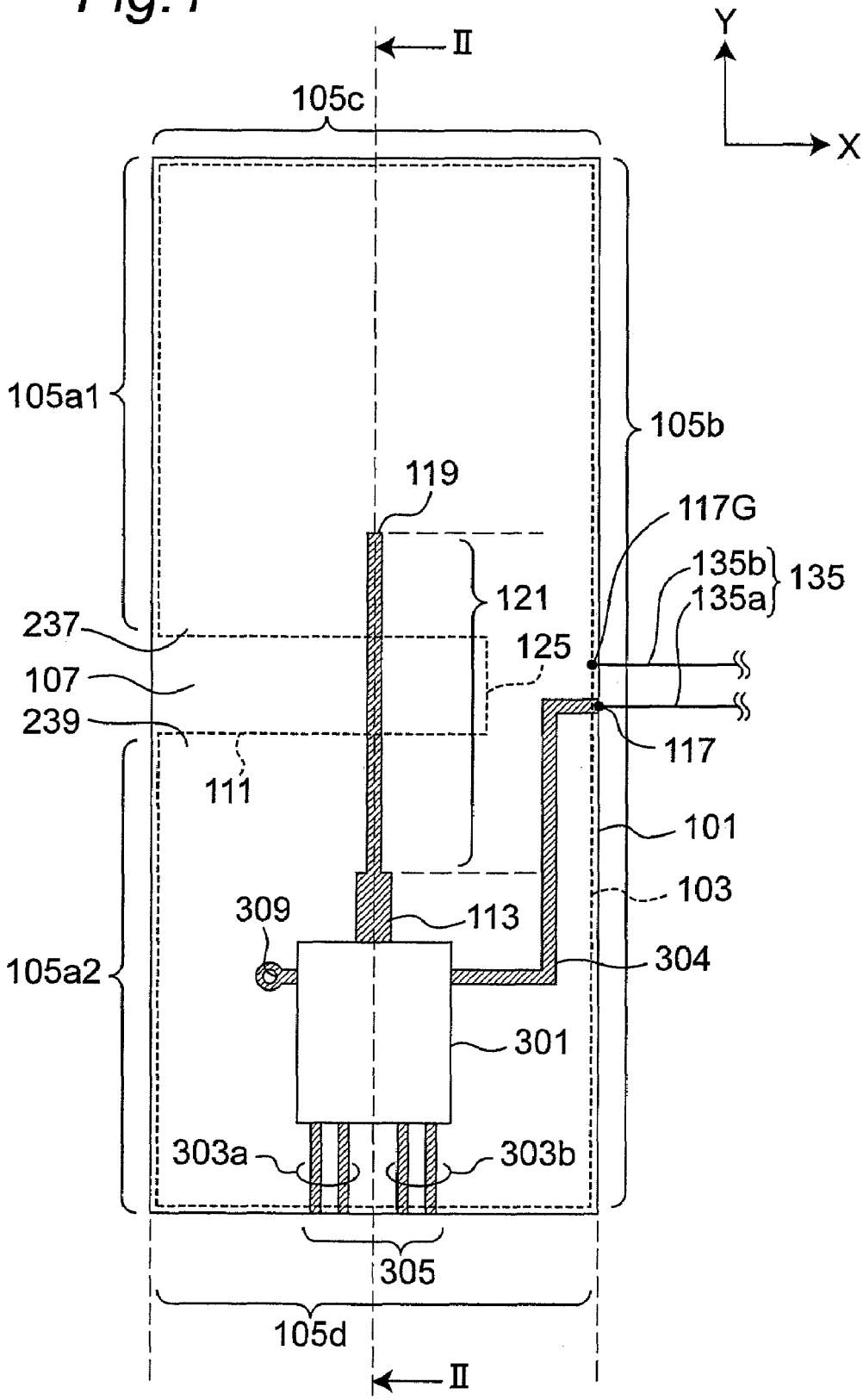
FIG. 1 is a schematic top view showing a structure of a wideband slot antenna apparatus according to a first preferred embodiment of the present invention.

Preferred embodiments according to the present invention will be described below with reference to the drawings. It is noted that in the drawings the same reference numerals denote like components.

First Preferred Embodiment

Figure 2:
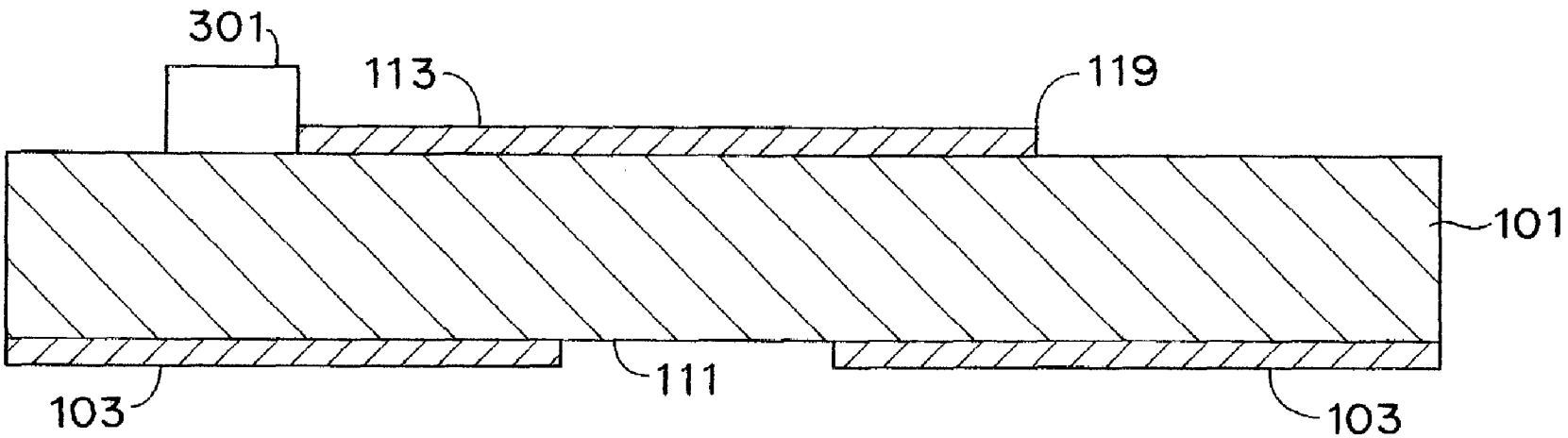
FIG. 2 is a schematic cross-sectional view along line II-II of FIG. 1.

FIG. 1 is a schematic top view showing a structure of a wideband slot antenna apparatus according to a first preferred embodiment of the present invention. FIG. 2 is a schematic cross-sectional view along line II-II of FIG. 1. In schematic top views of FIG. 1 and others, the structure of a backside of a substrate 101 is shown in phantom view (i.e., by dotted lines). For the purpose of explanation, refer to XYZ coordinates as shown in the respective drawings.

The wideband slot antenna apparatus according to the preferred embodiment of the present invention is characterized by including: a grounding conductor 103 with an outer edge including a first portion facing a radiation direction (i.e., a −X direction) and a second portion other than the first portion; a one-end-opened slot 111 formed in the grounding conductor 103 along the radiation direction such that an open end 107 is provided at the center of the first portion of the outer edge of the grounding conductor 103; a radio-frequency feed line 113 configured with a strip conductor close to the grounding conductor 103 and intersecting with the slot 111 at least a portion thereof to feed a radio-frequency signal to the slot 111; balanced feed lines 303*a* and 303*b* configured with strip conductors close to the grounding conductor 103 and connected to an external circuit; and a radio-frequency signal processing circuit 301 that is connected between the radio-frequency feed line 113 and the balanced feed lines 303*a* and 303*b*, and connected to the grounding conductor 103, includes active elements, and performs certain processes on a radio-frequency signal to be transmitted and received. Furthermore, the wideband slot antenna apparatus according to the preferred embodiment of the present invention is characterized in that the grounding conductor 103 is configured to be symmetric about an axis passing through the slot 111 and parallel to the radiation direction, and provided with a grounding terminal 117G on the axis of symmetry of the grounding conductor 103 at the second portion of the outer edge of the grounding conductor 103, to be connected to the ground of the external circuit, and that as a result of providing the grounding terminal 117G on the axis of symmetry of the grounding conductor 103, the grounding terminal 117G has a higher input and output impedance than an impedance in an unbalanced mode of the grounding conductor 103. By this configuration, it is possible to eliminate unstable radiation due to a grounding structure (i.e., a position of a grounding terminal connected to an external grounding conductor structure).

Referring to FIG. 1, the grounding conductor 103 with a finite area and a certain shape is formed on the backside of the dielectric substrate 101. The grounding conductor 103 is substantially configured in a polygonal shape, including one side at which the one-end-opened slot 111 is formed, and a plurality of other sides. In the case of the present preferred embodiment, the grounding conductor 103 is rectangular, and includes sides 105*a*1 and 105*a*2 on the −X side, a side 105*b* on the +X side, a side 105*c* on the +Y side, and a side 105*d* on the −Y side. The rectangular slot 111 with a width "Ws" and a length "Ls" is configured by forming a notch on the grounding conductor 103 at about the midpoint on the −X side of the grounding conductor 103 (i.e., the point between the first portion 105*a*1 and the second portion 105*a*2 on the −X side), in a direction orthogonal to the −X side (i.e., +X direction). Accordingly, an end on the −X side of the slot 111 is configured as the open end 107, and an end on the +X side is configured as a short-circuited end 125. The slot 111 operates as a one-end-opened feeding slot resonator with one-quarter effective wavelength (slot antenna mode). When assuming that the slot width "Ws" is negligible as compared with the slot length "Ls", a resonant frequency "fs" of the slot 111 is a frequency at which one-quarter of the effective wavelength is equivalent to the slot length "Ls". When such assumption is not valid, the apparatus is configured such that a slot length (Ls×2+Ws)/2 with considering the slot width is equivalent to one-quarter effective wavelength. In each preferred embodiment of the present invention, it is desirable that the resonant frequency "fs" of the slot 111 is set to the extent of a center frequency "f0" of an operating frequency band (e.g., 3.1 GHz to 10.6 GHz). On a front-side of the dielectric substrate 101 is formed the radio-frequency feed line 113 extending in a direction substantially orthogonal to the slot 111 (i.e., a Y-axis direction), and intersecting with the slot 111 at least a part thereof in overlapping manner. A partial region of the radio-frequency feed line 113 is configured as an inductive region 121, as will be described in detail later. The radio-frequency feed line 113 is configured as a microstrip line made of the grounding conductor 103, the strip conductor on the front-side of the dielectric substrate 101, and the dielectric substrate 101 therebetween. For ease of explanation in this specification, hereinafter, refer only the strip conductor on the front-side as the radio-frequency feed line 113. The main beam direction of radiation from the slot 111 is in a direction from the short-circuited end 125 to the open end 107 of the slot 111 (i.e., the −X direction), and accordingly, in this specification, the −X direction is considered as "forward", the +X direction is considered as "backward", and a Y-axis direction is called as the "width direction" of the wideband slot antenna apparatus. It is noted that this specification defines as a slot, a structure in which a conductor layer forming the grounding conductor 103 is completely removed in a thickness direction. That is, the slot is not a structure just reduced in thickness by scraping a surface of the grounding conductor 103 off in a partial region thereof. The radio-frequency feed line 113 is connected to the radio-frequency signal processing circuit 301 provided on the front-side of the dielectric substrate 101, and as will be described in detail later, the radio-frequency signal processing circuit 301 is connected to an external circuit (not shown) of the wideband slot antenna apparatus.

Figure 3:
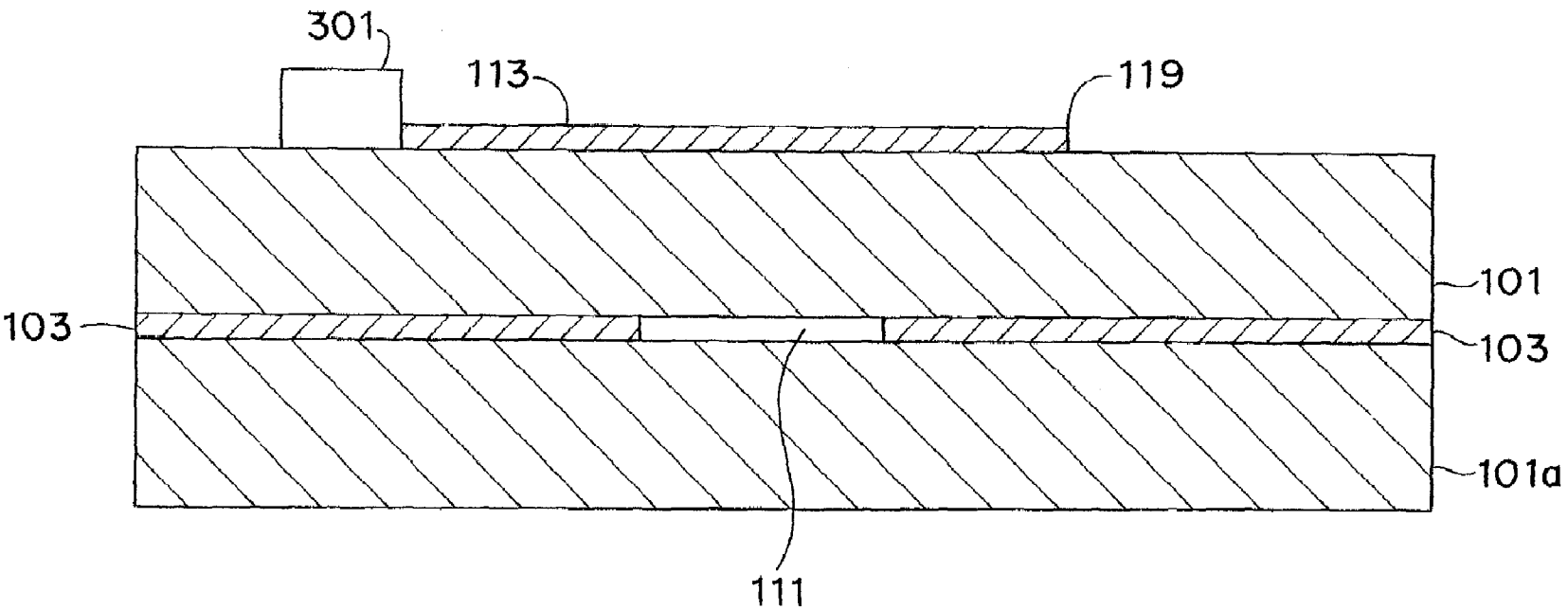
FIG. 3 is a schematic cross-sectional view showing a structure of a modified preferred embodiment with respect to the cross-sectional configuration in FIG. 2.

Although in this specification, the structure as shown in FIG. 2 is mainly described in which the radio-frequency feed line 113 is provided on the front-side of the dielectric substrate 101 (i.e., an uppermost surface) and the grounding conductor 103 is provided on the backside of the dielectric substrate 101 (i.e., a lowermost surface), a different structure as shown in FIG. 3 may be adopted instead of the structure in FIG. 2. FIG. 3 is a schematic cross-sectional view showing a structure of a modified preferred embodiment with respect to the cross-sectional configuration in FIG. 2. A wideband slot antenna apparatus shown in FIG. 3 is configured with a dielectric layer 101*a* provided on an underside of the grounding conductor 103, in addition to the configuration in FIG. 2. As described above, the wideband slot antenna apparatus of the preferred embodiment may adopt a multilayer substrate, and in this case, either or both of the radio-frequency feed line 113 and the grounding conductor 103 may be arranged on an inner-layer plane of the substrate. Further, a number of conductor surfaces for wiring lines operating as the grounding conductor 103 opposed to the radio-frequency feed line 113 need not to be limited to one in a structure, and a structure may be adopted in which the two grounding conductors are arranged such that they are opposed to each other and such that a layer with the radio-frequency feed line 113 formed thereon is between them. In other words, in the wideband slot antenna apparatus according to the preferred embodiment of the present invention, it is possible to obtain the same effect not only with the circuitry adopting a microstrip line structure, but also with the circuitry adopting a strip line structure in at least part of the apparatus. The same also applies in the case that each of the coplanar line and ground coplanar line structures is adopted.

Grounding Conductor 103 Operating as Dipole Antenna

Next, conditions imposed on the size in the width direction of the grounding conductor 103 will be described. The grounding conductor 103 is the conductor structure with the finite area as described above, and particularly, configured to include on the −X side, the portion 105*a*1 extending in the +Y direction from the open end 107 by a length "Wg1", and the portion 105*a*2 extending in the −Y direction from the open end 107 by a length "Wg2". In this case, each of the lengths "Wg1" and "Wg2" of the sides 105*a*1 and 105*a*2 on the −X side is larger than or equal to a length "Lsw" equivalent to one-quarter effective wavelength at the resonant frequency "fs" of the slot 111. This condition is desirable for stabilizing antenna radiation characteristics in the slot antenna mode.

By limiting the circuit of the grounding conductor 103 according to the preferred embodiment of the present invention to a finite area, the grounding conductor 103 can also operate in a grounding conductor dipole antenna mode in which the entire grounding conductor structure is used. In either case of the grounding conductor dipole antenna mode, and the slot antenna mode of the slot 111, it is common that a radio-frequency current concentrates at the short-circuited end 125 of the slot 111. Thus, the either antenna uses a common circuit board, and at the same time, provides common radiation characteristics in polarization characteristics. Additionally, each main beam direction of not only radiation in the slot antenna mode but also radiation in the grounding conductor dipole antenna mode is in the −X direction. Thus, if the resonant frequency "fd" in the grounding conductor dipole antenna mode can be set to be different from, and slightly lower than the resonant frequency "fs" of the slot 111, the wideband slot antenna apparatus according to the preferred embodiment of the present invention can achieve characteristics in which the operating band is dramatically extended to the lower frequency side as compared to the case of using only the slot antenna mode. Since the slot 111 is provided at substantially the center of the grounding conductor 103, the effective length of the resonator in the grounding conductor dipole antenna mode is extended. Therefore, in the wideband slot antenna apparatus according to the preferred embodiment of the present invention, when the lengths "Wg1" and "Wg2" of the side portions 105*a*1 and 105*a*2 on the −X side are configured to be larger than or equal to the length "Lsw" equivalent to one-quarter effective wavelength, the resonant frequency "fd" in the grounding conductor dipole antenna mode is always lower than the resonant frequency "fs" of the slot 111, and thus a wideband operation is ensured. In this case, the frequency "fd" is a lower limit frequency "fL" of the operating band of the wideband slot antenna apparatus (e.g., 3.1 GHz, as described above). From the point of view of size reduction, it is not practical to set the lengths "Wg1" and "Wg2" of the side portions 105*a*1 and 105*a*2 on the −X side to be extremely large so that the frequency "fd" is considerably lower than the frequency "fs". In other words, by setting either of the lengths "Wg1" and "Wg2" of the side portions 105*a*1 and 105*a*2 on the −X side to a minimum value required which is greater than or equal to the length "Lsw", it is possible in an embodiment of a small antenna, to bring the resonant frequency "fd" in the grounding conductor dipole antenna mode, close to the operating band in the slot antenna mode.

Inductive Region 121 Introduced into Radio-Frequency Feed Line 113

As shown in FIG. 1, a region extending over a certain length "Lind" from an open-ended point 119 of the radio-frequency feed line 113 is configured as an inductive region 121 formed of a wiring line with a higher characteristic impedance than a characteristic impedance (i.e., 50 ohms) of the radio-frequency feed line 113. The length "Lind" has a value equivalent to the extent of one-quarter effective wavelength at the resonant frequency "fs" of the slot 111 (i.e., as described above, the frequency equal to the center frequency "f0" of the operating band of the wideband slot antenna apparatus). That is, the inductive region 121 forms a one-quarter effective wavelength resonator, and is coupled to the one-quarter effective wavelength resonator formed by the slot 111, thus achieving double resonance, and as a result, the antenna operating band of the slot 111 in the slot antenna mode is effectively increased. The inductive region 121 intersects with the slot 111 at substantially the center of the longitudinal direction (i.e., the Y-axis direction) of the inductive region 121.

It is noted that even when the grounding conductor of the first prior art example is limited to a finite area, if the operating band in the slot antenna mode itself is limited, it is considerably difficult to ensure continuity with a band in the grounding conductor dipole antenna mode, and thus, the same effect as that according to the preferred embodiment of the present invention can not be obtained. As described above, by extending the operating band in the slot antenna mode to the lower frequency side, it is possible to achieve antenna operation in a wide operating band, in continuation of the operating band in the grounding conductor dipole antenna mode.

Connection Between the Radio-Frequency Signal Processing Circuit 301 and an External Circuit On the front-side of the dielectric substrate 101 is provided the radio-frequency signal processing circuit 301, by which the radio-frequency feed line 113 is connected to at least one other feed line provided on the front-side of the dielectric substrate 101 (in the case of FIG. 1, connected to the balanced feed lines 303*a* and 303*b*, each composed of two parallel strip-shaped signal line conductors). The latter feed line is connected to an external circuit (not shown) for processing radio-frequency signals, through a radio-frequency feeding point 305 provided at a certain position of the outer edge of the dielectric substrate 101. In the present preferred embodiment, the radio-frequency feeding point 305 is provided at substantially the center of the side 105*d* on the −Y side of the dielectric substrate 101. By this configuration, the radio-frequency signal processing circuit 301 performs a certain signal-conversion on transmitting signals inputted from the external circuit through the balanced feed lines 303*a* and 303*b* and outputs the signals to the radio-frequency feed line 113, and performs a certain signal-conversion on receiving signals inputted through the radio-frequency feed line 113 and outputs the signals to the balanced feed lines 303*a* and 303*b*. Further, the radio-frequency signal processing circuit 301 is connected to the grounding conductor 103, through a grounding electrode 309 made of a through-hole conductor passing through the dielectric substrate 101. Since the grounding conductor 103 is rectangular as described above, the grounding conductor 103 is configured to be symmetric about the axis passing through the slot 111 and parallel to the radiation direction (X-axis direction), and is provided with the grounding terminal 117G at substantially the center of the side 105*b* on the +X side (i.e., on the axis of symmetry). The grounding terminal 117G is connected to the ground of the external circuit, through an external conductor 135*b* of a coaxial cable 135. If necessary, the radio-frequency signal processing circuit 301 is further connected to a control line 304 provided on the front-side of the dielectric substrate 101. The control line 304 extends to a control terminal 117 provided at a certain position of the outer edge of the dielectric substrate 101, and is connected to the external circuit through the control terminal 117. In the present preferred embodiment, the control terminal 117 is provided close to the grounding terminal 117G, and connects the control line 304 to the external circuit through an internal conductor 135*a* of the same coaxial cable 135 as that connecting the grounding conductor 103 to the ground of the external circuit. In the present preferred embodiment, the balanced feed lines 303*a* and 303*b* and the control line 304 are configured as microstrip lines, in a similar manner to that of the radio-frequency feed line 113.

The radio-frequency signal processing circuit 301 includes at least an active element, such as an amplifier or a switch for changing transmission/reception. The active elements in the radio-frequency signal processing circuit 301 can be controlled by the external circuit through the coaxial cable 135 and the control line 304. It is necessary to input a reference potential in order to achieve correct operation of the active elements within the radio-frequency signal processing circuit 301, and accordingly, the radio-frequency signal processing circuit 301 is connected to the ground of the external circuit through the grounding electrode 309, the grounding conductor 103, and the grounding terminal 117G. Hence, the grounding terminal 117G can be considered as a DC feeding point. In the present preferred embodiment, since the radio-frequency feed line 113 is the unbalanced feed line, and the feed lines to be connected to the external circuit are the balanced feed lines 303*a* and 303*b*, the radio-frequency signal processing circuit 301 further includes a balanced/unbalanced conversion circuit. Additionally, the radio-frequency signal processing circuit 301 may include a bandpass filter circuit or a band-stop filter circuit in addition to the balanced/unbalanced conversion circuit, and furthermore, may be configured as an integrated module including the active elements and some or all of the above-described circuits.

The position for the radio-frequency feeding point 305 of the balanced feed lines 303*a* and 303*b* need not necessarily to be the center of the side 105*d* on the −Y side of the dielectric substrate 101. Further, the position for the control terminal 117 need not necessarily to be the center of the side 105*b* on the +X side of the dielectric substrate 101. On the other hand, the position for the grounding terminal 117G must be substantially the center of the side 105*b* on the +X side, as will be described below.

Figure 4:
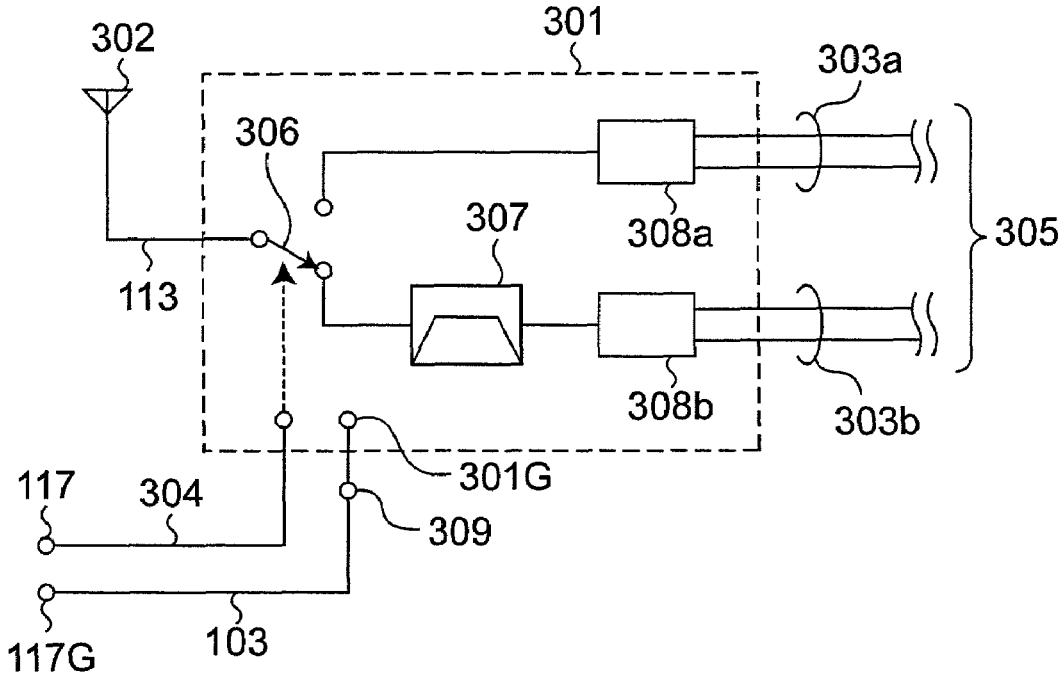
FIG. 4 is a block diagram of a radio-frequency signal processing circuit 301 of the wideband slot antenna apparatus in FIG. 1.
Figure 5:
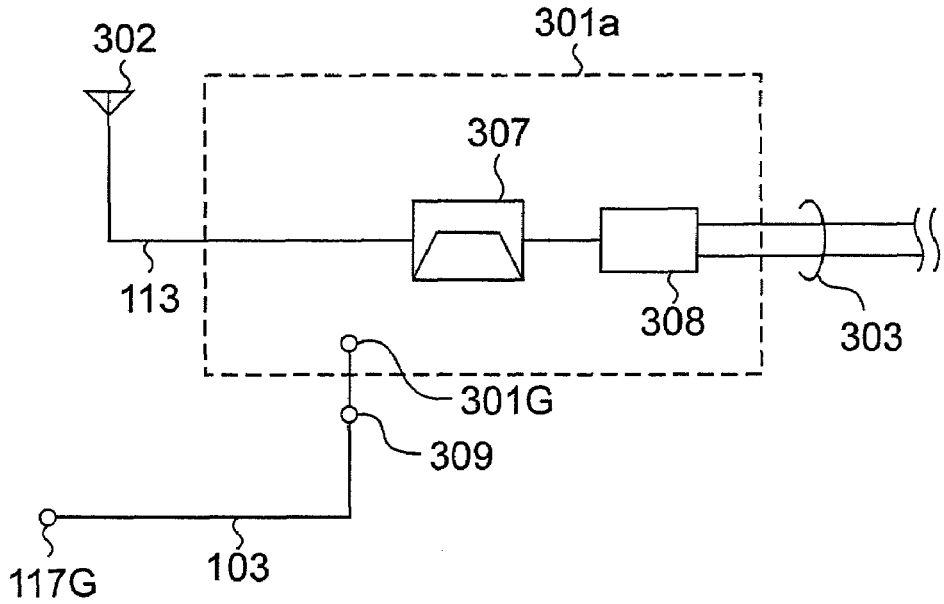
FIG. 5 is a block diagram showing a radio-frequency signal processing circuit 301*a* according to a modified preferred embodiment with respect to the radio-frequency signal processing circuit 301 in FIG. 4.

FIG. 4 is a block diagram of the radio-frequency signal processing circuit 301 of the wideband slot antenna apparatus in FIG. 1. The radio-frequency signal processing circuit 301 is configured as a circuit surrounded by a dashed line in FIG. 4. It is noted that in FIG. 4, an "antenna 302" connected to the radio-frequency feed line 113 is a symbol schematically showing an end point of a circuit in which radio-frequency signals are radiated into or received from space. That is, the antenna 302 corresponds to the inductive region 121 of the radio-frequency feed line 113 in FIG. 1. The radio-frequency signal processing circuit 301 shown in FIG. 4 is configured such that it is connected to one antenna 302 and two sets of balanced feed lines 303*a* and 303*b*, and it connects one of the balanced feed lines 303*a* and 303*b* to the radio-frequency feed line 113 by means of a radio-frequency switch IC 306 controlled by the external circuit through the control line 304. In the radio-frequency signal processing circuit 301, a balanced/unbalanced conversion circuit 308*a* is provided between the balanced feed line 303*a* and the radio-frequency switch IC 306, and a balanced/unbalanced conversion circuit 308*b* and a bandpass filter 307 are provided in series between the balanced feed line 303*b* and the radio-frequency switch IC 306. A ground 301G of the radio-frequency signal processing circuit 301 is connected to the grounding conductor 103 through the grounding electrode 309, as described above. On the other hand, FIG. 5 is a block diagram showing a radio-frequency signal processing circuit 301*a* according to a modified preferred embodiment with respect to the radio-frequency signal processing circuit 301 in FIG. 4. The radio-frequency signal processing circuit 301*a* shown in FIG. 5 is configured such that it is connected to one antenna 302 and a one set of balanced feed line 303. In the radio-frequency signal processing circuit 301*a* configured as shown in FIG. 5, a bandpass filter 307 and a balanced/unbalanced conversion circuit 308 are provided in series between a radio-frequency feed line 113 and the balanced feed line 303. The circuit shown in FIG. 4 can be used for the case in which, for example, a transmitting signal is transmitted through the balanced feed line 303*a* and a receiving signal is transmitted through the balanced feed line 303*b*, with the antenna 302 being shared for both transmission and reception by using the radio-frequency switch IC 306. The circuit shown in FIG. 5 can be used for the case in which the antenna 302 is used for reception only. In either case of FIGS. 4 and 5, radio-frequency signal are fed through a connection between the balanced feed line(s) 303*a* and 303*b* or 303 and a balanced line of an external circuit (not shown), and thus, the grounding conductor 103 can be configured at the radio-frequency feeding point 305 so as not to be connected to the external circuit. Accordingly, it is possible to avoid flowing an unbalanced current into the external circuit, which will be described later, and therefore, ideal feeding of radio-frequency signals can be achieved.

It is noted that a radio-frequency signal processing circuit to be provided in the wideband slot antenna apparatus according to the preferred embodiment of the present invention is not limited to that of the examples in FIGS. 4 and 5. The configuration in FIG. 4 is for a time division duplex scheme (a scheme for alternately transmitting and receiving signals by short time intervals). However, instead of using the radio-frequency switch IC 306, it is possible to use a duplexer which is a frequency filter used in a frequency division duplex scheme (a scheme for transmitting and receiving signals by using separate frequency bands from each other), or a diplexer used for sharing an antenna among a plurality of communication schemes. It is also possible to implement an impedance matching circuit in the radio-frequency signal processing circuit.

Figure 6:
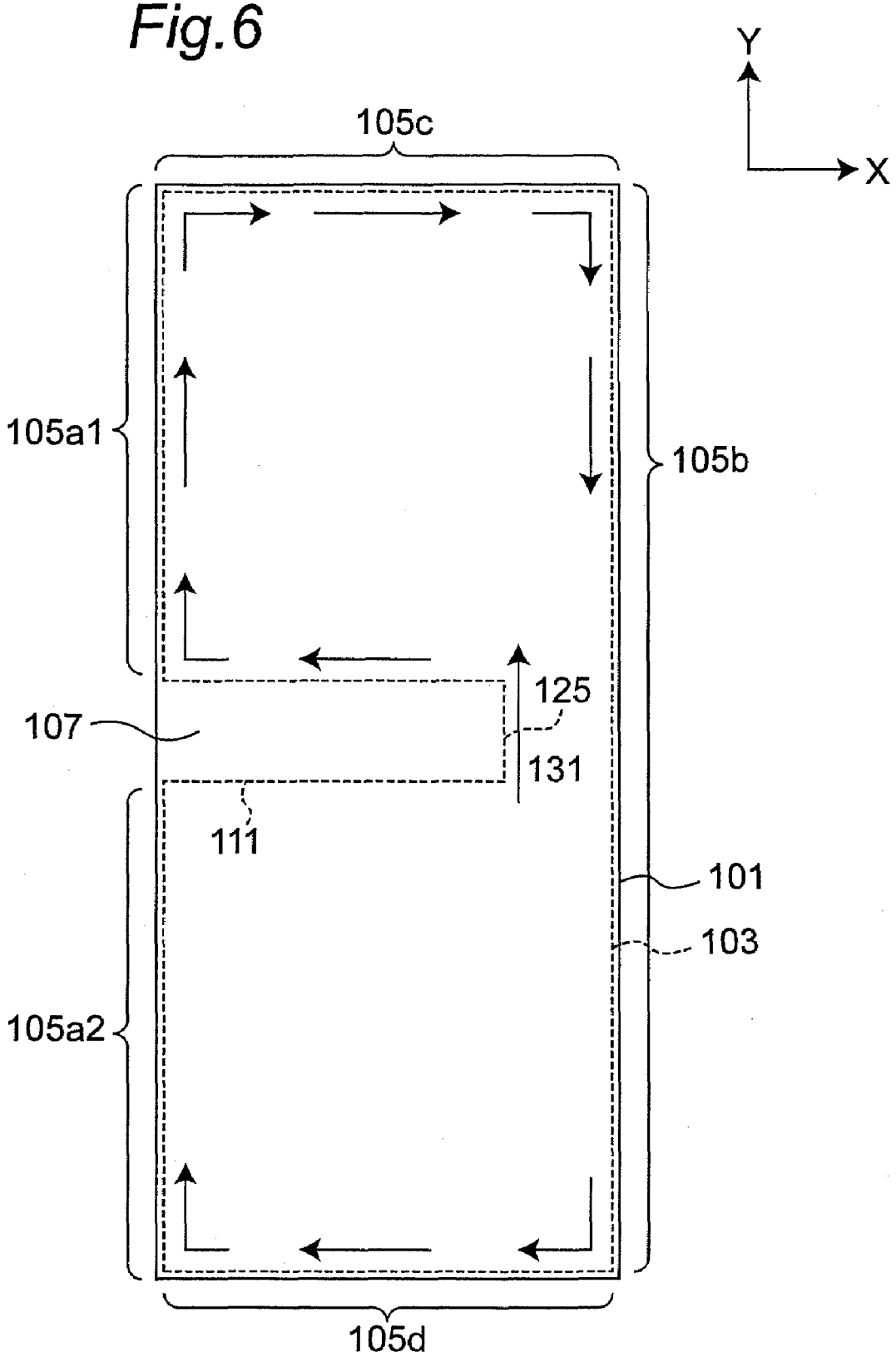
FIG. 6 is a schematic view showing a radio-frequency current flowing through a grounding conductor 103 of the wideband slot antenna apparatus in FIG. 1.

In the slot antenna mode appearing by exciting the slot 111 through the radio-frequency feed line 113, radio-frequency currents commonly appear at the short-circuited end 125 of the slot 111. FIG. 6 is a schematic view showing a radio-frequency current flowing through the grounding conductor 103 of the wideband slot antenna apparatus in FIG. 1. As shown by arrows in FIG. 6, the appeared radio-frequency current flows along boundaries between the slot 111 and the grounding conductor 103, and when reaching to the open end 107, the radio-frequency current flows along the outer edge of the grounding conductor 103. In this case, if another conductor is connected to the outer edge of the grounding conductor 103, since the impedance of the connected conductor is very low, it is extremely difficult to prevent the radio-frequency current from flowing through the connected conductor. However, by providing the grounding terminal 117G at a position of high symmetry as described above, an extremely high input and output impedance is achieved with respect to a radio-frequency current flowing on the grounding conductor 103 in the unbalanced mode (this current has an impedance in the unbalanced mode). Further, it is possible to design the grounding conductor 103 so as not to be connected to the external circuit at the radio-frequency feeding point 305 at which the balanced feed lines 303*a* and 303*b* are connected to the external circuit, thus avoiding flowing an unbalanced grounding conductor current at the radio-frequency feeding point 305 into the external circuit.

Figure 7:
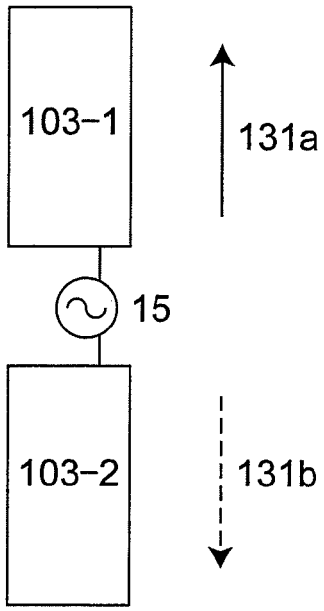
FIG. 7 is a schematic view showing how radio-frequency currents flow in the grounding conductor 103 for the case of a balanced mode.
Figure 8:
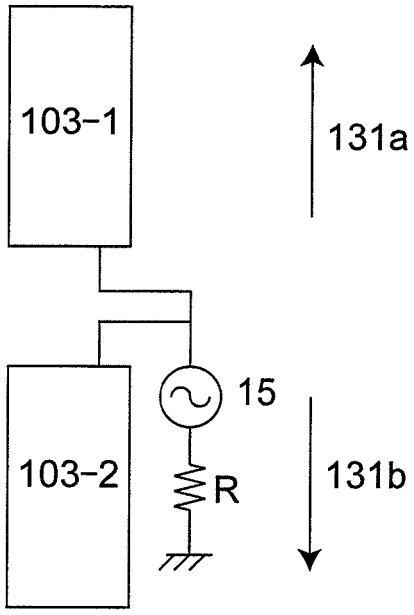
FIG. 8 is a schematic view showing how radio-frequency currents flow in the grounding conductor 103 for the case of an unbalanced mode.

The grounding conductor 103 in the wideband slot antenna apparatus structure shown in FIG. 1 can be considered to be a conductor structure in which a pair of grounding conductors 103-1 and 103-2 with a high symmetry and a finite area are combined at the short-circuited end 125 of the slot 111. FIG. 7 is a schematic view showing how radio-frequency currents flow in the grounding conductor 103 for the case of the balanced mode. FIG. 8 is a schematic view showing how radio-frequency currents flow in the grounding conductor 103 for the case of the unbalanced mode. FIGS. 7 and 8 schematically show how radio-frequency currents flow in the grounding conductor 103, as relationships to feed structures in the respective modes. In the balanced mode, equivalently, the pair of grounding conductors 103-1 and 103-2 are fed with radio-frequency currents 131*a* and 131*b* with opposite phases, each flowing in a direction of arrow from a feeding point 15, and as a result, the largest radio-frequency current with the same phase flows at a connecting point between the pair of grounding conductors, i.e., the short-circuited end 125 of the slot 111. On the other hand, in the unbalanced mode, equivalently, the pair of grounding conductors 103-1 and 103-2 are fed with radio-frequency currents 131*a* and 131*b* with the same phase, each flowing in a direction of arrow from the feeding point 15 (which is considered to be grounded through a certain impedance R), and as a result, the radio-frequency currents can be cancelled at the connecting point between the pair of grounding conductors, i.e., at the antenna feeding point 15. This means that the more symmetrically the pair of grounding conductors 103-1 and 103-2 are configured, and the closer the grounding terminal 117G is positioned to the symmetry point of the grounding conductor 103, the higher the input and output impedance of the grounding conductor 103 at the grounding terminal 117G in the unbalanced mode is. Hence, by adopting the conditions for providing the grounding terminal 117G according to the preferred embodiment of the present invention, even when an external circuit is connected to the grounding conductor 103, it is possible to avoid backflow of an unbalanced grounding conductor current to the external circuit.

It is noted that in the one-half effective wavelength slot antenna according to the third prior art example, radio-frequency currents appearing at short-circuited points at both ends of the slot resonator flow only along the outer edge of the slot, and no current flows along the outer edge of the grounding conductor 103. Thus, a problem caused by an unbalanced grounding conductor current flowing along the outer edge of the grounding conductor 103 is specific to the case in which an one-end-opened slot resonator, which is advantageous to size reduction and extending of a band, is adopted for unbalanced feeding.

It is noted that in the wideband slot antenna apparatus according to the preferred embodiment of the present invention, the shape of the slot 111 need not to be rectangular, and its shape can be replaced by any shape. Particularly, connecting a number of thin and short slots in parallel to a main slot is equivalent, as the circuitry, to adding inductances in series to the main slot, and thus, it is desirable in practice because the slot length of the main slot can be reduced. enabling to reduce the slot length of the main slot, and thus, it is desirable in practice. Further, it is possible to obtain the effect of extending the band of the wideband slot antenna apparatus according to the preferred embodiment of the present invention as well, even under a condition in which the main slot is reduced in the slot width and bent into a shape such as a meander shape, for the purpose of the size reduction.

It is noted that in the wideband slot antenna apparatus according to the preferred embodiment of the present invention, a feed line between the radio-frequency feeding point 305 and the radio-frequency signal processing circuit 301 is not limited to a balanced feed line, and may be an unbalanced feed line. Even in this case, by providing the grounding terminal 117G at substantially the center of the side 105*b* on the +X side of the grounding conductor 103, it is possible to obtain advantageous effects according to the preferred embodiment of the present invention.

Second Preferred Embodiment

Figure 9:
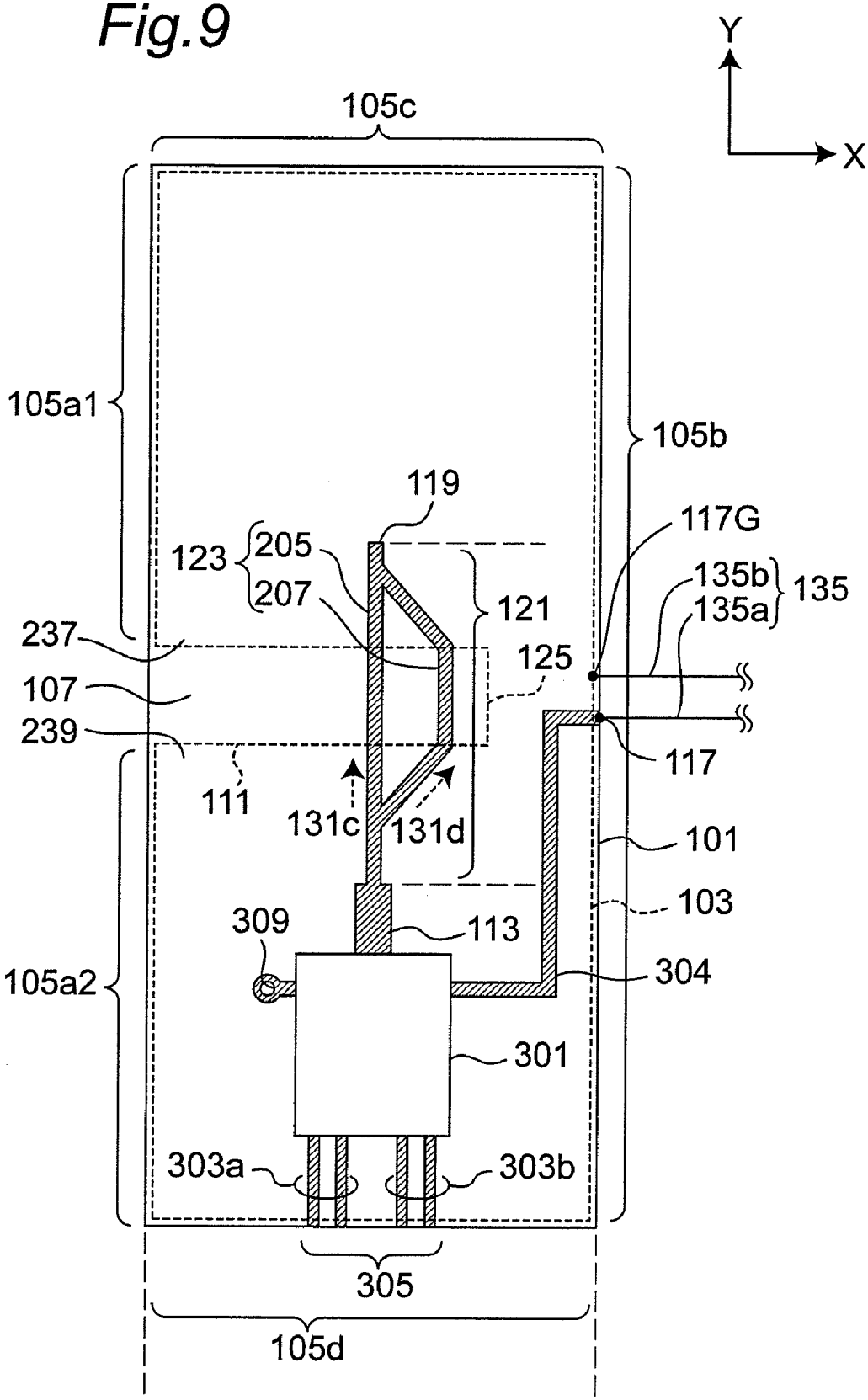
FIG. 9 is a schematic top view showing a structure of a wideband slot antenna apparatus according to a second preferred embodiment of the present invention.

Next, a wideband slot antenna apparatus according to a second preferred embodiment of the present invention will be described. FIG. 9 is a schematic top view showing a structure of a wideband slot antenna apparatus according to a second preferred embodiment of the present invention. In the second preferred embodiment, it is characterized in that at least a partial region (preferably, the inductive region 121) of the radio-frequency feed line 113 in FIG. 1 is replaced by a loop wiring line 123, thus achieving wideband characteristics wider than the wideband slot antenna apparatus according to the first preferred embodiment.

The radio-frequency feed line 113 is branched at a first position near the slot 111 into a group of branch lines including at least two branch lines, and at least two branch lines among the group of branch lines are connected to each other at a second position near the slot 111 and different from the first position, thus configuring at least one loop wiring line on the radio-frequency feed line 113.

As shown in FIG. 9, in the wideband slot antenna apparatus according to the present preferred embodiment, the inductive region 121 of the radio-frequency feed line 113 is replaced by a loop wiring line 123, near a location where the radio-frequency feed line 113 intersects with the slot 111. Therefore, the loop wiring line 123 intersects with at least one of a+Y-side boundary 237 and a −Y-side boundary 239 extending along a longitudinal direction of the slot 111 (i.e., the X-axis direction) and being defined between the slot 111 and the grounding conductor 103. The loop length "Llo" of the loop wiring line 123 is set to less than the effective wavelength at an upper limit frequency "fH" (e.g., 10.6 GHz, as described above) of the operating band of the wideband slot antenna apparatus. That is, a resonant frequency "flo" of the loop wiring line 123 is set to higher than the frequency "fH". The configuration of the radio-frequency feed line 113 is not limited to one including the loop wiring line 123, and the radio-frequency feed line 113 may be configured such that a part of the radio-frequency feed line 113 is branched off to form an open stub. In this case, the stub length of the open stub is set to less than a length equivalent to one-quarter effective wavelength at the upper limit frequency "fH" of the operating band. That is, a resonant frequency "fst" of the open stub is set to higher than the frequency "fH". As described above, in the second preferred embodiment, the band characteristics of the wideband slot antenna apparatus are dramatically improved by branching the radio-frequency feed line 113 into wiring lines at the inductive region 121. This improvement in characteristics does not result from purposely using a resonance phenomenon of the branched wiring lines themselves, but results from using a phenomenon arisen only when combining the slot 111 and the loop wiring line 123.

The loop wiring line 123 of the wideband slot antenna apparatus according to the preferred embodiment of the present invention achieves two features simultaneously, i.e., a feature of enabling to excite the slot 111 at multiple positions, and a feature of adjusting the electrical length of an input impedance matching circuit, thus achieving antenna operation with ultra-wideband characteristics. Then, the operations of the loop wiring line 123 will be described in detail below.

Figure 10:
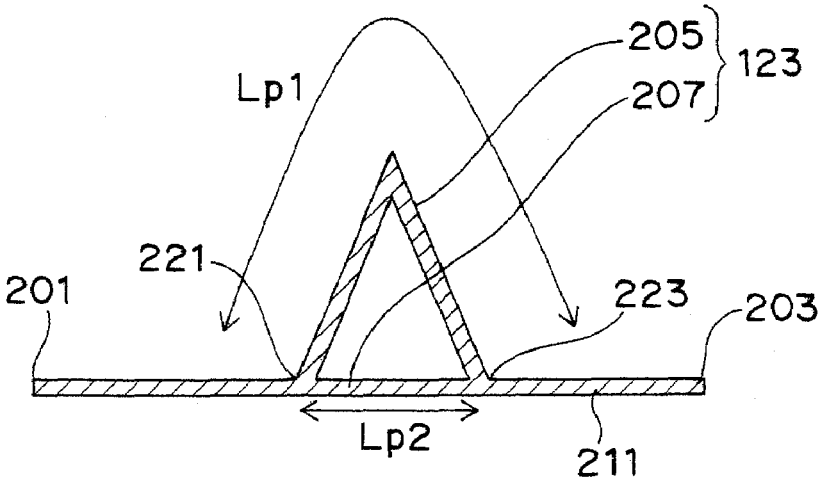
FIG. 10 is a schematic view of two circuits including branches in which a signal wiring line is branched as a loop wiring line, in a typical radio-frequency circuit structure with an infinite grounding conductor structure on a backside thereof.

Now, with reference to FIG. 10, radio-frequency characteristics will be described that occurs when a loop wiring line structure is used in a typical radio-frequency circuit which is assumed to have a grounding conductor with an infinite area on a backside thereof. FIG. 10 is a schematic circuit view in which a loop wiring line 123, including a first path 205 with a path length "Lp1" and a second path 207 with a path length "Lp2", is connected between an input terminal 201 and an output terminal 203. The loop wiring line 123 is in a resonance state on condition that the sum of the path lengths "Lp1" and "Lp2" is identical to the effective wavelength of a transmission signal. In some cases satisfying such condition, the loop wiring line 123 has been used as a ring resonator. However, when the sum of the path lengths "Lp1" and "Lp2" is shorter than the effective wavelength of a transmission signal, a steep frequency response is not obtained, and thus there is no particular necessity to use the loop wiring line 123 in a typical radio-frequency circuit. This is because in a typical radio-frequency circuit having a uniform grounding conductor with an infinite area, an influence of local variations in radio-frequency current distribution within an anti-resonant band, which is involved in incorporating the loop wiring line 123, is averaged as macro-scale radio-frequency characteristics.

On the other hand, by incorporating the loop wiring line 123 into the wideband slot antenna apparatus according to the preferred embodiment of the present invention as shown in FIG. 9, a unique effect is achieved that cannot be obtained by the aforementioned typical radio-frequency circuit. The loop wiring line 123 intersects with the boundaries 237 and 239 between the slot 111 and the grounding conductor 103, and the slot 111 is excited at two or more points at which the boundaries 237 and 239 intersect with the loop wiring line 123 and which are apart form the open end 107 of the slot 111 by different distances. Specifically, a radio-frequency current on the grounding conductor 103 is forced to flow in a direction 131*c* along the first path 205 of the loop wiring line 123, and to flow in a direction 131*d* along the second path 207 of the loop wiring line 123. As a result, different paths including 131*c* and 131*d* can be made as the flows of the radio-frequency current on the grounding conductor 103, and accordingly, the slot 111 can be excited at multiple positions. By locally changing the radio-frequency current distribution near the slot 111 in the grounding conductor 103, the resonance characteristics in the slot antenna mode are changed, thus dramatically extending the antenna operating band in the slot antenna mode.

Figure 13:
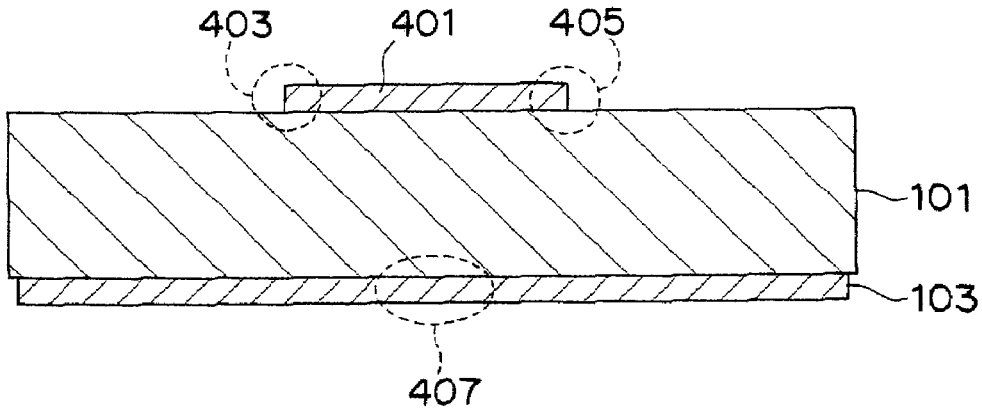
FIG. 13 is a cross-sectional view of a grounding conductor structure in which a typical transmission line is provided, for indicating portions where radio-frequency currents concentrate.
Figure 14:
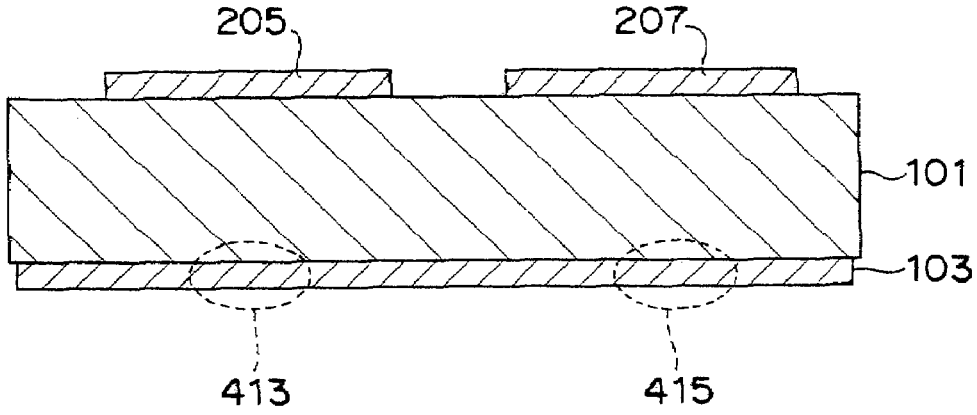
FIG. 14 is a cross-sectional view of a grounding conductor structure in which branched transmission lines are provided, for indicating portions where radio-frequency currents concentrate.

FIGS. 13 and 14 schematically show cross-sectional views of transmission line structures for description. In a typical transmission line such as that shown in FIG. 13, a radio-frequency current distribution is concentrated at edges 403 and 405 of a wiring line on the side of a strip conductor (i.e., a feed line) 401, and in a region 407 opposing to a center portion of the strip conductor 401, on the side of a grounding conductor 103. Thus, it is difficult to cause large variations in a radio-frequency current distribution on the side of the grounding conductor 103, by only increasing the width of the strip conductor of the radio-frequency feed line 113 near the slot 111. As shown in FIG. 14, only by branching a strip conductor into two paths 205 and 207, separate radio-frequency currents can be produced in different grounding conductor regions 413, 415 each opposed to the path 205, 207.

The loop wiring line 123 newly incorporated into the wideband slot antenna apparatus according to the preferred embodiment of the present invention can not only have a feature of exciting the slot 111 at multiple positions, but also have a feature of adjusting the electrical length of the radio-frequency feed line 113. Due to variations in the electrical length of the radio-frequency feed line 113 resulting from incorporating the loop wiring line 123, the resonance state of the radio-frequency feed line 113 is changed to include multiple resonances, thus further enhancing the effect of extending the operating band according to the preferred embodiment of the present invention. That is, by incorporating the loop wiring line 123 near the slot 111, the electrical lengths of two paths 205 and 207 composing the loop wiring line 123 differ between the case of following a path of a shorter electrical length and the case of following another path of a longer electrical length, and this difference of electrical lengths causes a resonance phenomenon resulting from the coupling of the inductive region 121 to the slot 111 at a plurality of two or more frequencies, and accordingly, a wideband impedance matching condition which has been already achieved is further extended.

As descried above, since the first feature of providing the resonance phenomenon of the slot 111 itself with multiple resonances is combined to the second feature of providing the resonance phenomenon of the feed line 113 coupled to the slot 111 with multiple resonances, the wideband slot antenna apparatus according to the preferred embodiment of the present invention can operate in a wider band than that of prior art slot antenna apparatuses.

In the present preferred embodiment, the radio-frequency feeding point 305, the control terminal 117, and the grounding terminal 117G are arranged on the grounding conductor 103 in the same manner as that for the wideband slot antenna apparatus according to the first preferred embodiment.

It is noted that as a constraint for the loop wiring line 123 in order to maintain wideband impedance matching characteristics, it becomes necessary to use the loop wiring line 123 on a condition for not causing a resonation of the loop wiring line 123 itself. For example, referring to the loop wiring line 123 shown in FIG. 10, a loop length "Lp" which is the sum of the path lengths "Lp1" and "Lp2" is set to less than the effective wavelength at the upper limit frequency "fH" of the operating band. When there are a plurality of loop wiring lines in the structure, the largest loop wiring line of such loop wiring lines that do not include any further small loop therein must satisfy the above-described condition.

Figure 11:
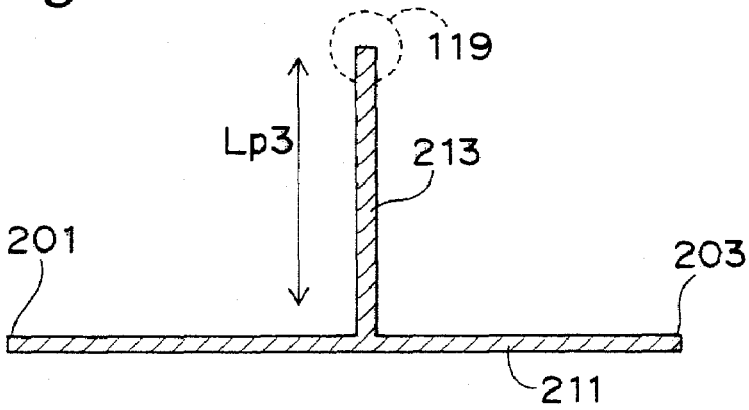
FIG. 11 is a schematic view of two circuits including branches in which a signal wiring line branches off an open-ended stub wiring line, in a typical radio-frequency circuit structure with an infinite grounding conductor structure on a backside thereof.
Figure 12:
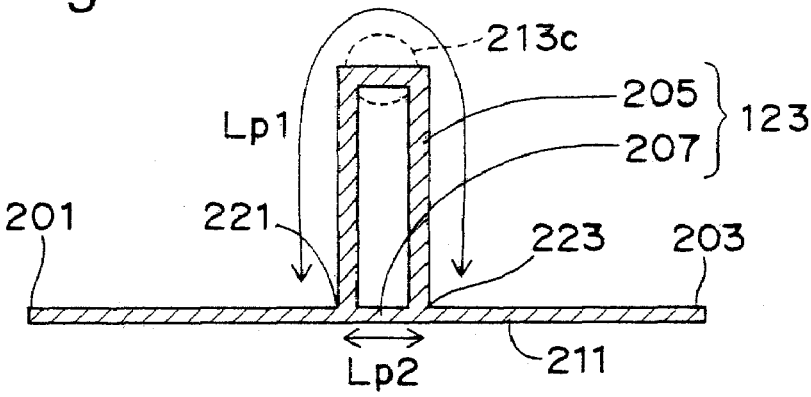
FIG. 12 is a schematic view of two circuits including branches in which a signal wiring line is branched as a loop wiring line, and particularly, in which a second path is configured to be extremely short, in a typical radio-frequency circuit structure with an infinite grounding conductor structure on a backside thereof.
Figure 15:
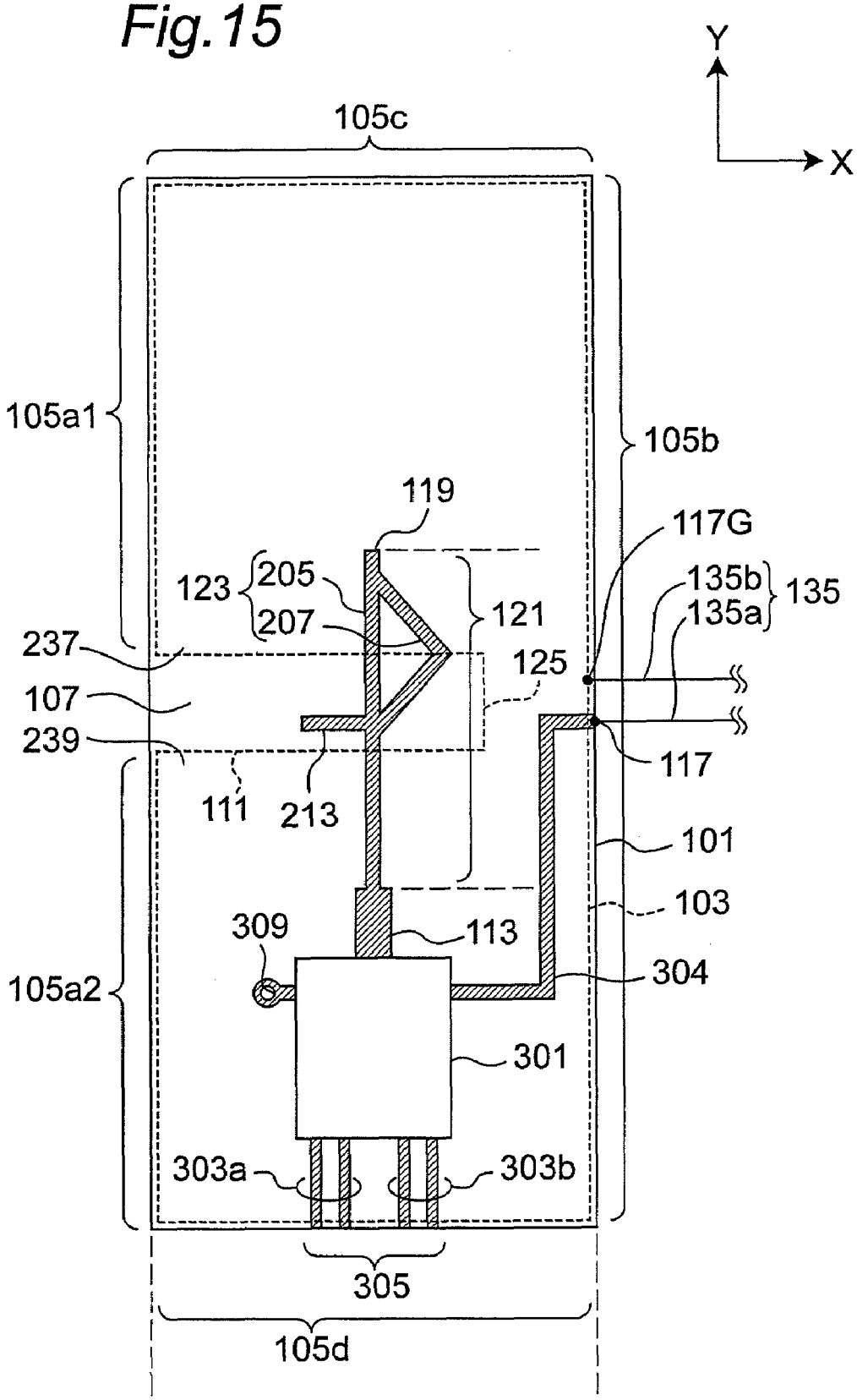
FIG. 15 is a schematic top view showing a structure of a wideband slot antenna apparatus according to a first modified preferred embodiment of the second preferred embodiment of the present invention.

On the other hand, as a more common radio-frequency circuit than a loop wiring line, an open stub shown in FIG. 11 is provided. FIG. 15 is a schematic top view showing a structure of a wideband slot antenna apparatus according to a first modified preferred embodiment of the second preferred embodiment of the present invention. As shown in FIG. 15, some of wiring lines into which the radio-frequency feed line 113 of the wideband slot antenna apparatus according to the preferred embodiment of the present invention is branched may adopt the structure of an open stub 213. However, for the object of the present invention, the use of a loop wiring line is more advantageous than the use of an open stub in terms of wideband characteristics. Since the open stub 213 is a one-quarter effective wavelength resonator, a stub length "Lp" is, even in the longest case, set to less than a length equivalent to one-quarter effective wavelength at the frequency "fH". FIG. 12 shows an extreme example of the loop wiring line 123, illustrating an advantageous feature of the loop wiring line 123 over the open stub 213. When reducing the length "Lp2" of one path in the loop wiring line 123 to be extremely short, an appearance of the loop wiring line 123 approximates to that of the open stub 213 as closely as desired. However, the resonant frequency of the loop wiring line 123 for the case with the path length "Lp2" close to 0 is a frequency at which the effective wavelength is equivalent to the other path length "Lp1", and on the other hand, the resonant frequency of the open stub 213 is a frequency at which one-quarter of the effective wavelength is equivalent to a path length "Lp3" of the open stub 213. Comparing these two structures under an assumption that a half of the path length "Lp1" of the loop wiring line 123 is equal to the path length "Lp3" of the open stub 213, the lowest-order resonant frequency of the loop wiring line 123 is equivalent to twice the lowest-order resonant frequency of the open stub 213. According to the above description, as a feed line structure for avoiding an undesired resonance phenomenon in a wide operating band, the loop wiring line 123 is twice as effective in terms of a frequency band as the open stub 213. Further, since the circuit is opened at an open-ended termination point 119 of the open stub 213 in FIG. 11, no radio-frequency current flows at that point, and thus, even if the open-ended termination point 119 is provided near the slot 111, it is hard to electromagnetically couple it to the slot 111. On the other hand, as shown in FIG. 12, the circuit is never opened at a point 213*c* of the loop wiring line 123, and a radio-frequency current always flows at that point, and thus, if the point 213*c* is provided near the slot 111, it is easy to electromagnetically couple it to the slot 111. Also from this point of view, it is advantageous to adopt a loop wiring line than an open stub for the object of the present invention.

According to the above description, it is shown that in order to extend the bandwidth of the wideband slot antenna apparatus according to the preferred embodiment of the present invention, it is most effective to incorporate a loop wiring line, rather than adopting a line with thick line width, or an open stub.

Figure 16:
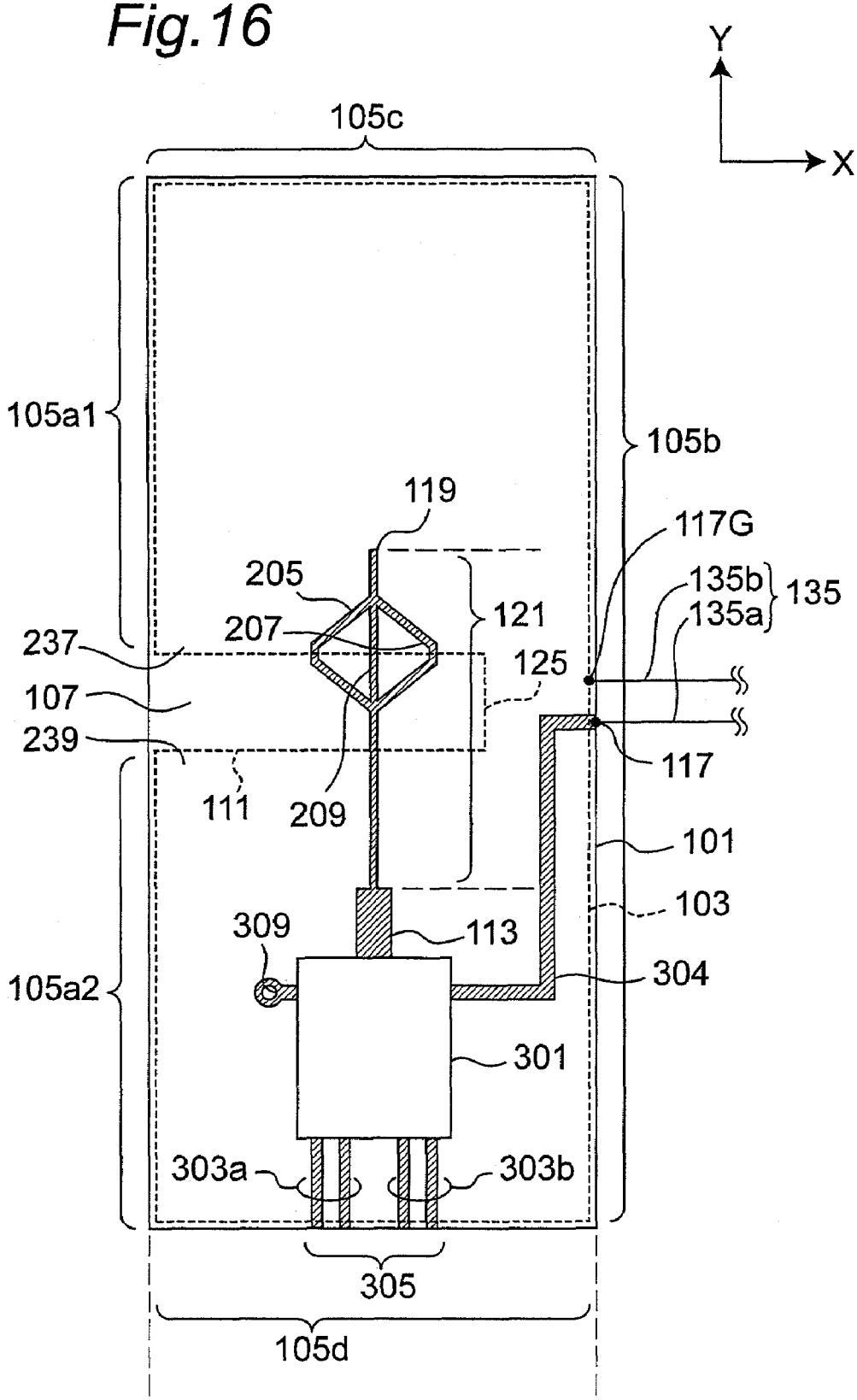
FIG. 16 is a schematic top view showing a structure of a wideband slot antenna apparatus according to a second modified preferred embodiment of the second preferred embodiment of the present invention.

FIG. 16 is a schematic top view showing a structure of a wideband slot antenna apparatus according to a second modified preferred embodiment of the second preferred embodiment of the present invention. The modified preferred embodiment in FIG. 16 shows the case in which a branch line portion of a radio-frequency feed line 113 includes three branches. By inserting a path 209 into middle of paths 205 and 207, a loop wiring line including the paths 205 and 209 and a loop wiring line including the paths 207 and 209 are formed, instead of an original loop wiring line including the paths 205 and 207. A maximum value of the respective loop lengths of these loop wiring lines is set to a length less than one effective wavelength at an upper limit frequency of the operating band of the wideband slot antenna apparatus. According to the configuration of the present modified preferred embodiment, since the path lengths of the loop wiring lines are reduced as compared to the case of FIG. 9, thus increasing the resonant frequencies of the loop wiring lines, it is effective in terms of the extension of the operating band.

Although three or more branch lines can be configured into which the radio-frequency feed line 113 is branched, a much wider extension of the operating band characteristics cannot be expected as compared to the case in which the radio-frequency feed line 113 is branched into two branch lines. This is because the distribution of radio-frequency currents concentrates at only the leftmost and rightmost paths 205 and 207 among the group of branch lines, and the intensity of a radio-frequency current flowing through the path 209 provided between the paths 205 and 207 is not high. However, by inserting the path 209 into middle of the paths 205 and 207, the resonant frequency of the loop wiring line including the paths 205 and 207 can be increased, and thus, it is effective in terms of the extension of the operating band.

Figure 17:
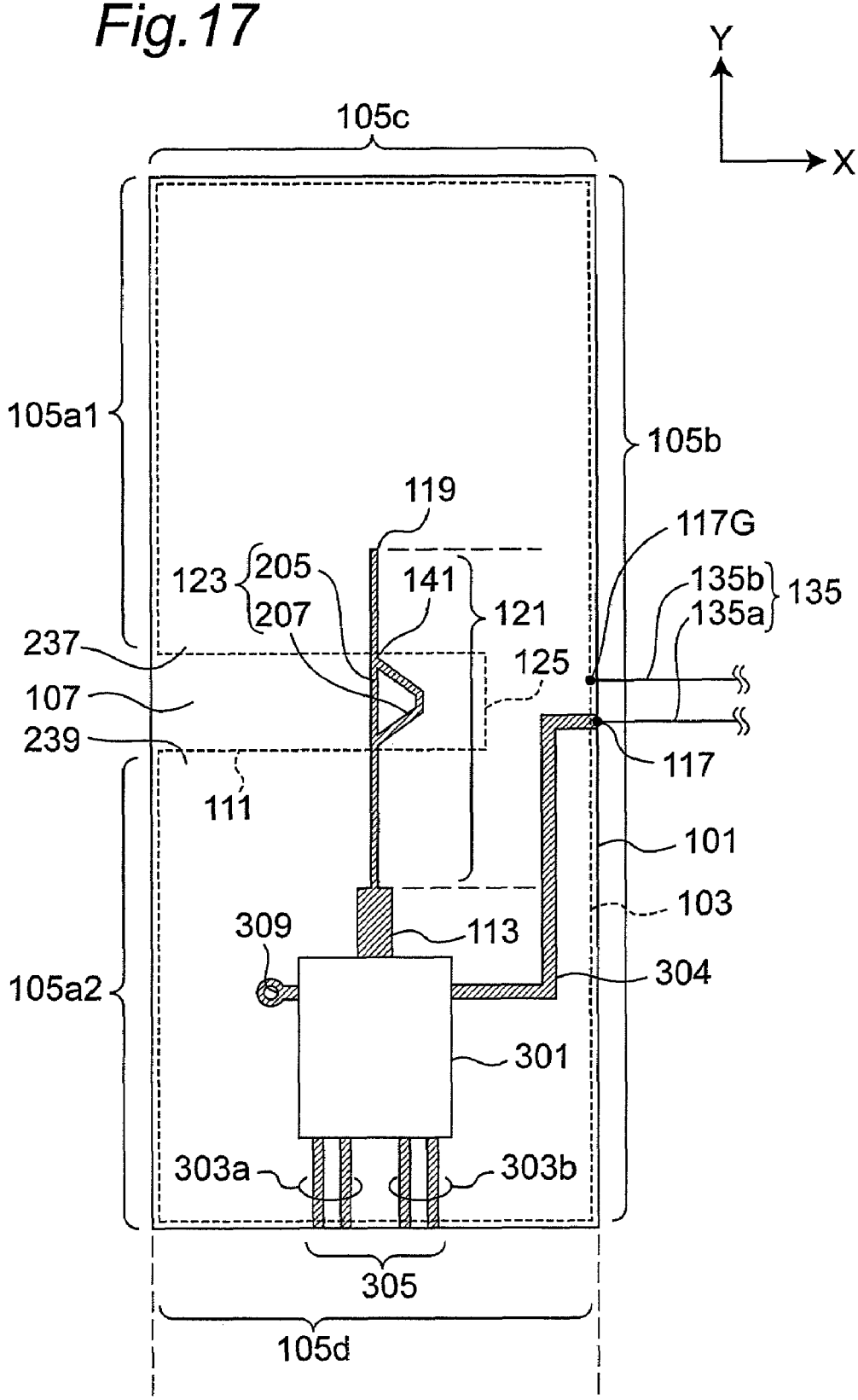
FIG. 17 is a schematic top view showing a structure of a wideband slot antenna apparatus according to a third modified preferred embodiment of the second preferred embodiment of the present invention.
Figure 18:
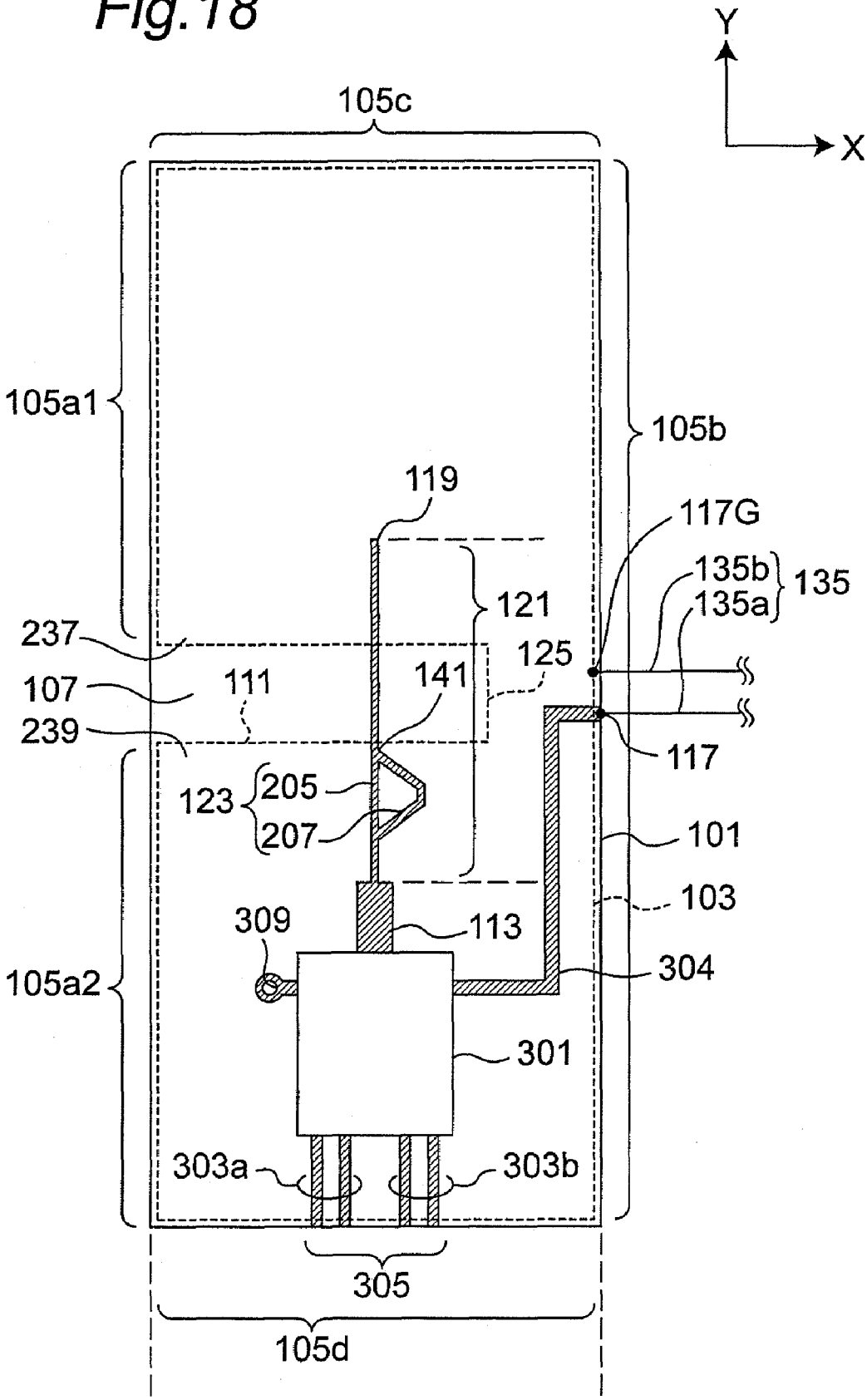
FIG. 18 is a schematic top view showing a structure of a wideband slot antenna apparatus according to a fourth modified preferred embodiment of the second preferred embodiment of the present invention.

FIG. 17 is a schematic top view showing a structure of a wideband slot antenna apparatus according to a third modified preferred embodiment of the second preferred embodiment of the present invention. FIG. 18 is a schematic top view showing a structure of a wideband slot antenna apparatus according to a fourth modified preferred embodiment of the second preferred embodiment of the present invention. With reference to FIGS. 17 and 18, a relationship between positions of the loop wiring line 123 and the slot 111 will be described.

With respect to the positional relationship between the loop wiring line 123 and the slot 111, the effects according to the preferred embodiment of the present invention can be obtained, under the condition that the loop wiring line 123 is provided near the slot 111. Preferably, as shown in FIG. 9, the paths 205 and 207 of the loop wiring line 123 intersect with at least one of the +Y-side boundary 237 and the −Y-side boundary 239 extending along the longitudinal direction of the slot 111. However, as shown in the modified preferred embodiments in FIGS. 17 and 18, it is possible to obtain the effects according to the preferred embodiment of the present invention even with a configuration in which the loop wiring line 123 does not intersect with either of the boundaries 237 and 239 between the slot 111 and the grounding conductor 103. This is because a phase difference in radio-frequency currents exciting the slot 111 occurs which corresponds to a path difference between a first path 205 and a second path 207, thus producing an effect of extending an input impedance matching condition to a wider band. Strictly speaking, spacing between an outermost (i.e., the +Y side) point 141 of the loop wiring line 123 and the boundary 237 (or 239) should be less than the line width of the radio-frequency feed line 113. This is because when the spacing is configured to be shorter than the line width of the radio-frequency feed line 113, a phase difference does not disappear, which occurs between local radio-frequency currents flowing on the side of the grounding conductor 103 corresponding to a phase difference between radio-frequency currents flowing through both edges of the strip conductor.

The loop wiring line 123 is formed within the inductive region 121. It is desirable that the line width of the loop wiring line 123 is configured to be equal to or thinner than the line width of the radio-frequency feed line 113 in the inductive region 121. A plurality of loop wiring lines may be formed. The plurality of loop wiring lines may be connected to each other in series or in parallel. Two of the loop wiring lines may be directly connected to each other, or may be indirectly connected to each other through a transmission line of any shape.

In the wideband slot antenna apparatus according the preferred embodiment of the present invention, a connection between the grounding conductor 103 and an external circuit at the grounding terminal 117G is not limited to be established on the backside of the dielectric substrate 101. Specifically, it is possible establish a connection to the external circuit from a grounding terminal on the front-side of the dielectric substrate 101, by providing the grounding terminal at substantially the center of the +X side on the front-side of the dielectric substrate 101, and connecting the grounding terminal to the grounding conductor 103 by a through-hole conductor passing through the dielectric substrate 101 from its front-side to its backside. Also in such configuration, advantageous effects according to the preferred embodiment of the present invention do not disappear. In fact, such configuration enables both connections for the radio-frequency signal conductors and for the grounding conductor on the front-side of the dielectric substrate 101, and thus, it is possible to mount the wideband slot antenna apparatus according to the preferred embodiment of the present invention onto a surface of an external mounting substrate.

Implementation Examples

Figure 19:
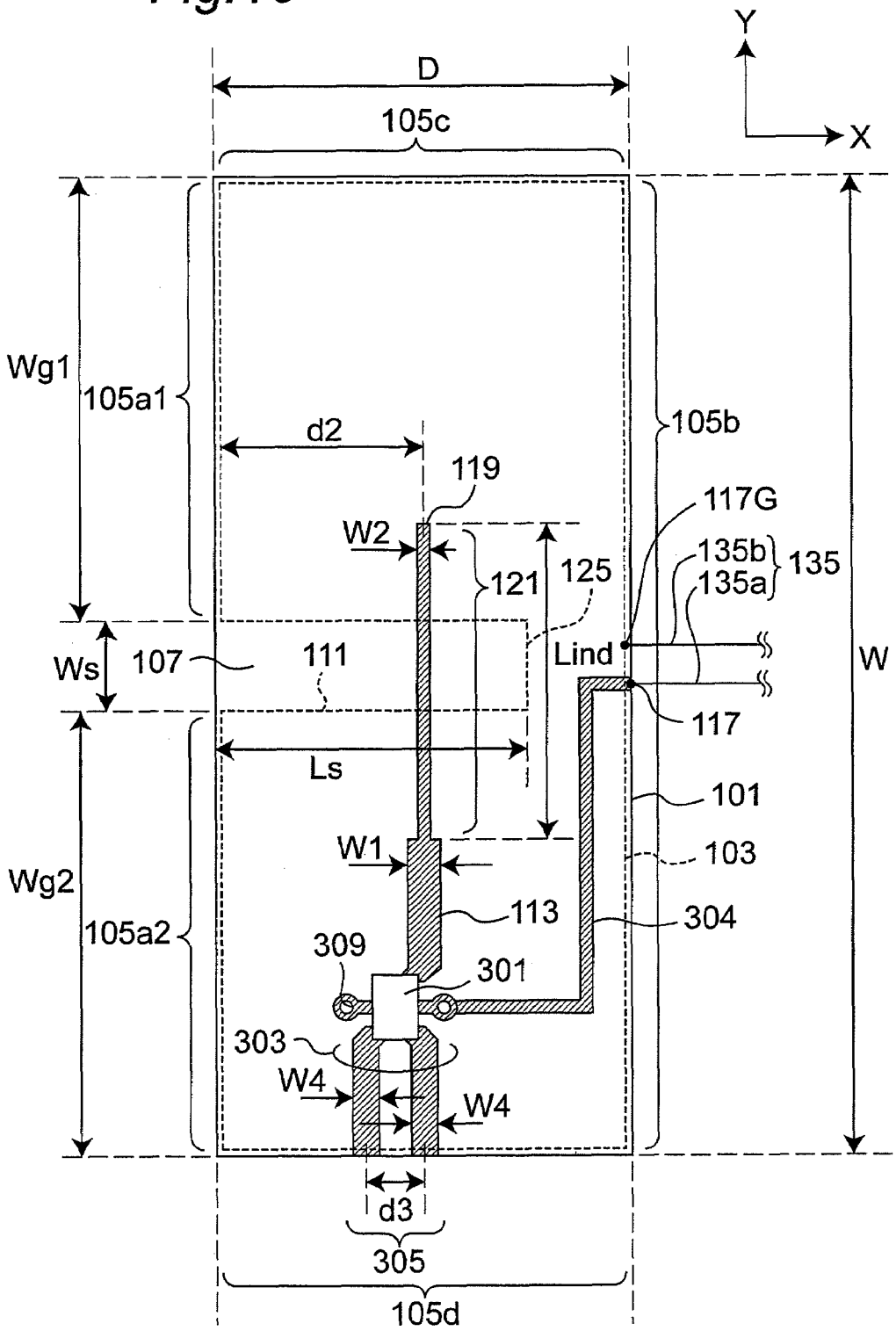
FIG. 19 is a schematic top view showing a structure of a wideband slot antenna apparatus according to a first implementation example of the present invention.
Figure 20:
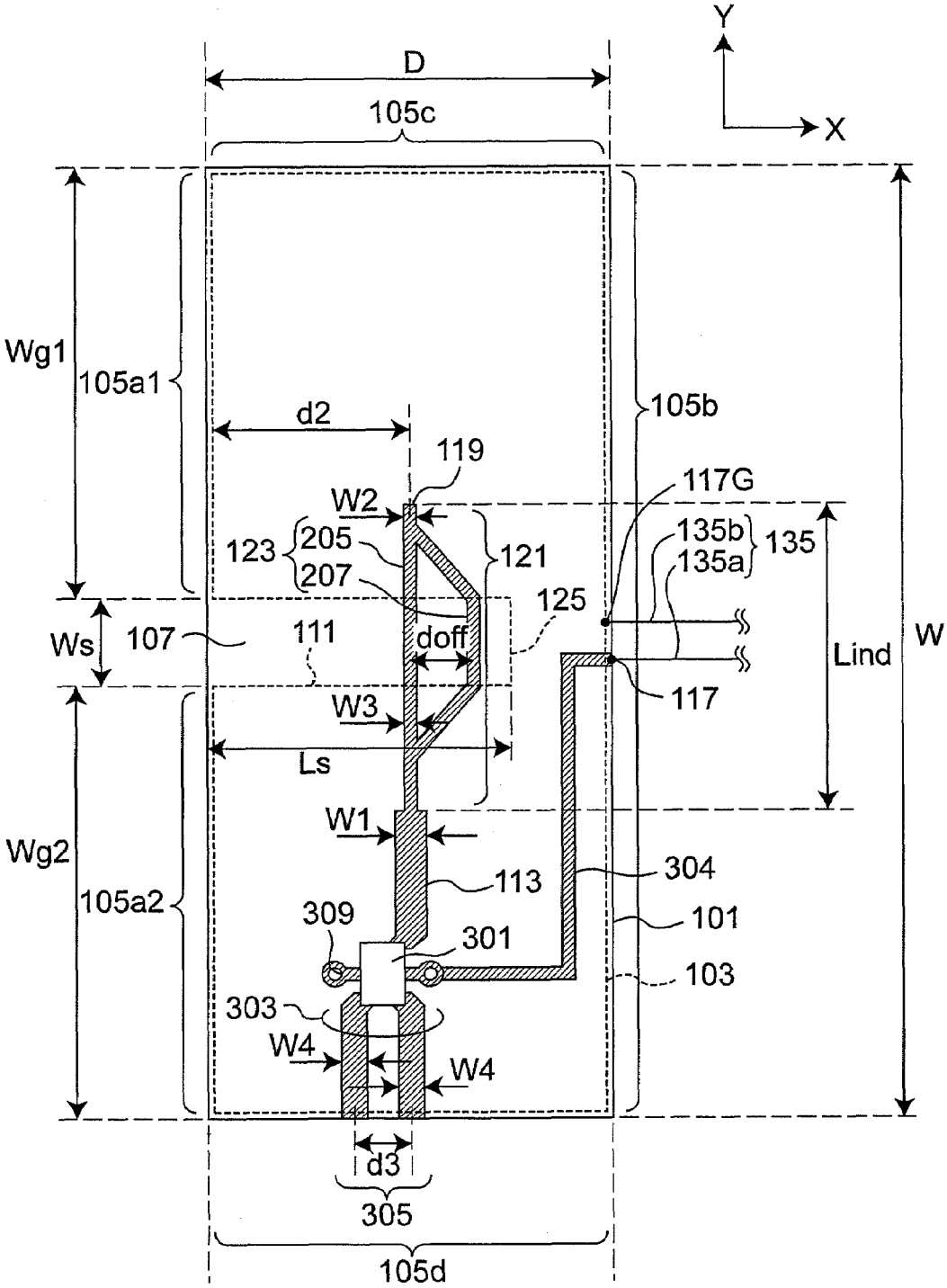
FIG. 20 is a schematic top view showing a structure of a wideband slot antenna apparatus according to a second implementation example of the present invention.
Figure 21:
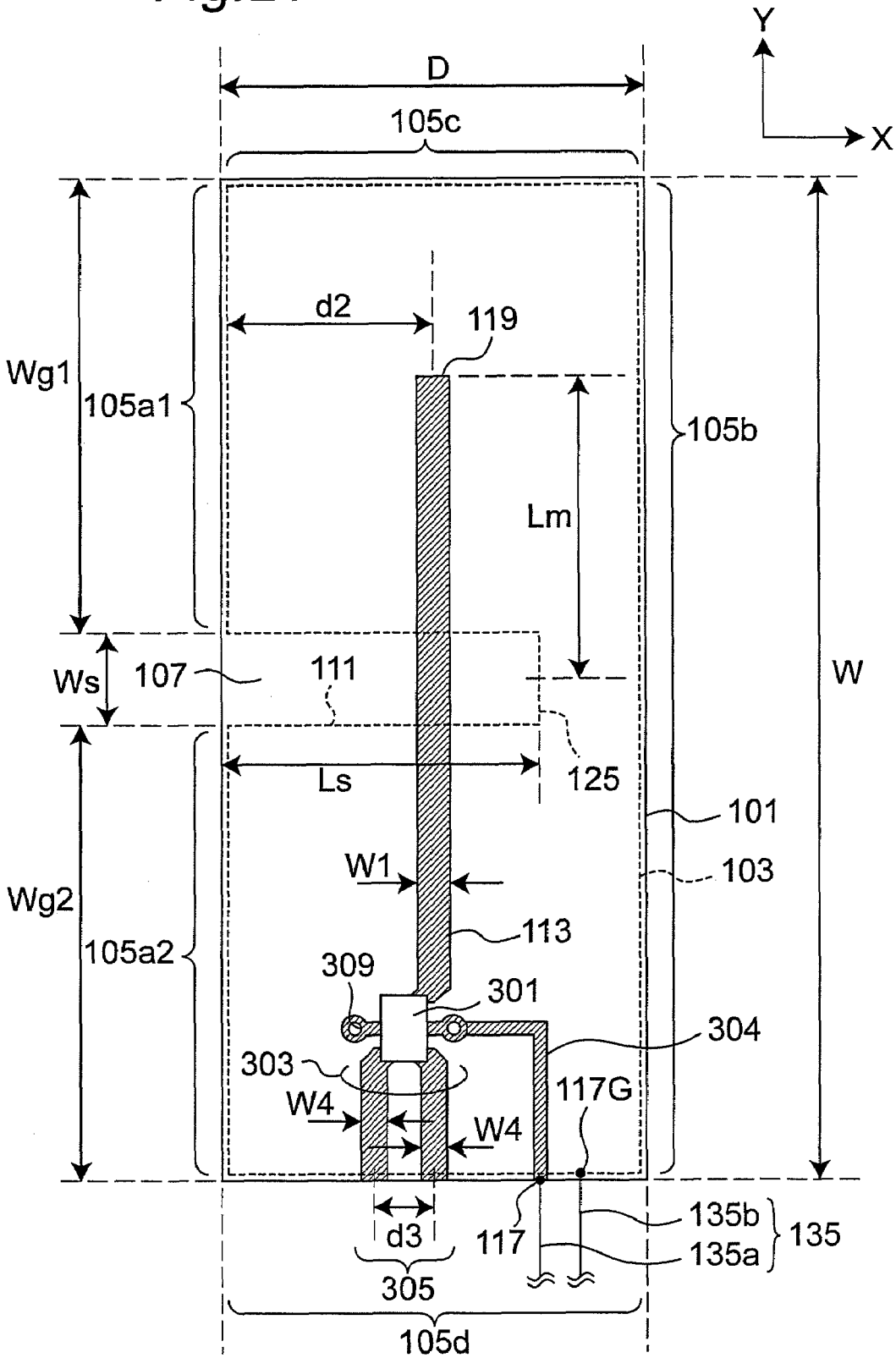
FIG. 21 is a schematic top view showing a structure of a wideband slot antenna apparatus according to first and second comparative examples of the present invention.

In order to clarify the effects according to the preferred embodiments of the present invention, the input impedance characteristics and radiation characteristics of slot antenna apparatuses of implementation examples of the present invention and slot antenna apparatuses of comparative examples were analyzed by a commercially available electromagnetic analysis simulator. FIG. 19 is a schematic top view showing a structure of a wideband slot antenna apparatus according to a first implementation example of the present invention. FIG. 20 is a schematic top view showing a structure of a wideband slot antenna apparatus according to a second implementation example of the present invention. FIG. 21 is a schematic top view showing a structure of a wideband slot antenna apparatus according to first and second comparative examples (as will be described later, these examples have different distance "Lm" of FIG. 19) of the present invention. Table 1 shows circuit board setting parameters common between first and second implementation examples of the present invention. Table 2 shows circuit board setting parameters common between first and second comparative examples.

TABLE 1

| | |
|---|---|
| Material of dielectric substrate 101 | FR4 |
| Thickness "H" of dielectric substrate 101 | 0.5 mm |
| Depth "D" of dielectric substrate 101 | 12 mm |
| Width "W" of dielectric substrate 101 | 30 mm |
| Thickness "t" of wiring | 0.04 mm |
| Slot length "Ls" | 9 mm |
| Slot width "Ws" | 2.4 mm |
| Lengths "Wg1" and "Wg2" of side portions 105a1 and 105a2 on the -X side | 13.8 mm |
| Width "W1" of radio-frequency feed line 113 | 0.95 mm |
| Width "W2" of inductive region 121 | 0.4 mm |
| Line width "W4" of balanced feed line 303 | 0.9 mm |
| Line spacing "d3" between balanced feed lines 303 | 1.2 mm |
| Distance "d2" of radio-frequency feed line 113 from open end 107 | 6 mm |

TABLE 1-continued

| | |
|---|---|
| Length "Lind" of inductive region 121 | 9 mm |
| Width "Was" of parasitic slot resonator | 0.5 mm |
| Distance "Das" from the -X side to open end of parasitic slot resonator | 3 mm |

TABLE 2

| | |
|---|---|
| Material of dielectric substrate 101 | FR4 |
| Thickness "H" of dielectric substrate 101 | 0.5 mm |
| Depth "D" of dielectric substrate 101 | 12 mm |
| Width "W" of dielectric substrate 101 | 30 mm |
| Thickness "t" of wiring | 0.04 mm |
| Slot length "Ls" | 9 mm |
| Slot width "Ws" | 2.4 mm |
| Lengths "Wg1" and "Wg2" of side portions 105a1 and 105a2 on the -X side | 13.8 mm |
| Width "W1" of radio-frequency feed line 113 | 0.95 mm |
| Line width "W4" of balanced feed line 303 | 0.9 mm |
| Line spacing "d3" between balanced feed lines 303 | 1.2 mm |
| Distance "d2" of radio-frequency feed line 113 from open end 107 | 6 mm |

In the second implementation example, the width "W3" of a loop wiring line 123 was 0.25 mm, and the distance "doff" between paths of the loop wiring line 123 was 1.4 mm. In the first comparative example, the offset distance "Lm" to a slot 111 from an open-ended termination point 119 of a radio-frequency feed line 113 was 4.5 mm, and in the second comparative example, the distance "Lm" was 9 mm. In each of the implementation examples and the comparative examples, it was assumed that as an external conductor 135*b* of a coaxial cable 135 for connecting a grounding terminal 117G of a grounding conductor 103 to the ground of an external circuit, a copper wire with a certain length "Lc" (hereinafter, referred to as the "copper wire 135") was connected to the grounding terminal 117G, and it was analyzed by changing the length "Lc" of the copper wire 135 to 0 mm, 50 mm, and 150 mm. It was assumed that ideal DC feeding (grounding) was done at an end of the copper wire 135 when the length "Lc" of the copper wire 135 was set to 50 mm and 150 mm, and thus, the slot antenna apparatuses were analyzed for the operation stability and wideband property, including an influence exerted on characteristics by the copper wire 135 with the length "Lc" connected as an unbalanced feed circuit. Also in the analysis, it was assumed that ideal DC feeding (grounding) was done at the grounding terminal 117G when the length "Lc" of the copper wire 135 was set to zero.

In all the slot antenna apparatuses, the conditions were set on the assumption that the apparatuses were fabricated using circuit boards of the same size. Conductor patterns were assumed to be copper wirings with a thickness of 40 microns, and were considered to be in an accuracy range in which the conductor patterns could be formed by wet etching process.

It was assumed that at each position in the drawings indicated as a radio-frequency feeding point 305, differential feeding to balanced feed lines 303 was done in a differential mode and with an input impedance of 100 ohms. In the implementation examples shown in FIGS. 19 and 20, since the grounding terminal 117G of the grounding conductor 103 was provided at substantially the center of the +X side, the orientation of the copper wire 135 was in the X-axis direction. On the other hand, in the comparative examples shown in FIG. 21, since the grounding terminal 117G was provided at the −Y side of a dielectric substrate 101, the orientation of the copper wire 135 was in the Y-axis direction. It is noted that a radio-frequency signal processing circuit 301 included a balanced/unbalanced conversion circuit which was of a passive circuit, and was assumed to have ideal circuit characteristics for each frequency. The size and electrode pattern of the radio-frequency signal processing circuit 301 were designed with a grounding electrode 309 made of a through-hole conductor, according to the specifications of a balanced/unbalanced conversion circuit product commercially available for short-range ultra-wideband wireless communication.

Figure 22:
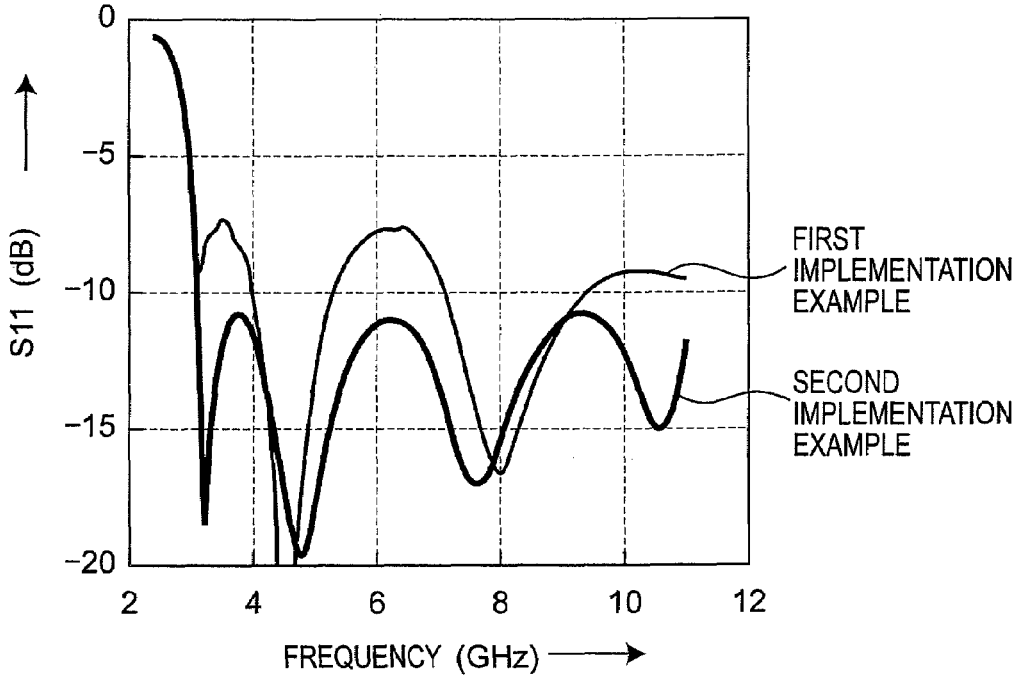
FIG. 22 is a graph showing the reflection loss versus frequency characteristics for the first and second implementation examples, in a case of Lc=150 mm.
Figure 23:
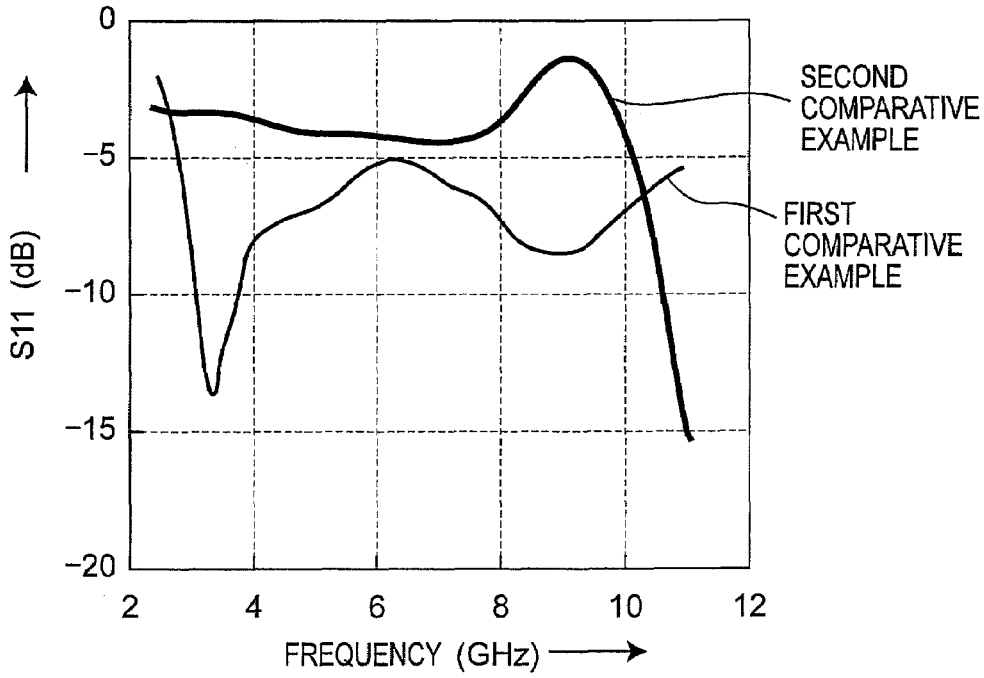
FIG. 23 is a graph showing the reflection loss versus frequency characteristics for the first and second comparative examples, in a case of Lc=150 mm.

FIG. 22 is a graph showing the reflection loss versus frequency characteristics for the first and second implementation examples, in a case of Lc=150 mm. FIG. 23 is a graph showing the reflection loss versus frequency characteristics for the first and second comparative examples, in a case of Lc=150 mm. Referring to FIG. 22, the first implementation example maintained a low reflection characteristic of −7.5 dB or less across a frequency range from 3.2 GHz to 11 GHz or higher. Furthermore, the second implementation example exhibited such wideband and low reflection characteristics that the reflection loss was −10 dB or less across the entire frequency band from 3.1 GHz to 11 GHz or higher. On the other hand, referring to FIG. 23, in the first comparative example, the reflection loss was less than −10 dB in a range from 3.04 GHz to 3.73 GHz, i.e., in 20% of the fractional bandwidth, and the reflection loss was less than −7.5 dB in a range from 2.9 GHz to 4.3 GHz, but the reflection loss reached −4.9 dB at 6.3 GHz, and thus wideband characteristics could not be obtained. In the second comparative example, the reflection loss was to the extent of −3 dB to −4 dB in a range from 2.5 GHz to 8 GHz, and thus low reflection characteristics could not be obtained. As is apparent from comparing the implementation examples of the present invention shown in FIG. 22 with the comparative examples shown in FIG. 23, the bandwidth of the operating band can be extended in both the first and second implementation examples. It is noted that in either of the implementation examples and the comparative examples, there was little influence exerted on the input impedance by the change in the length "Lc" of the copper wire 135.

Figure 24:
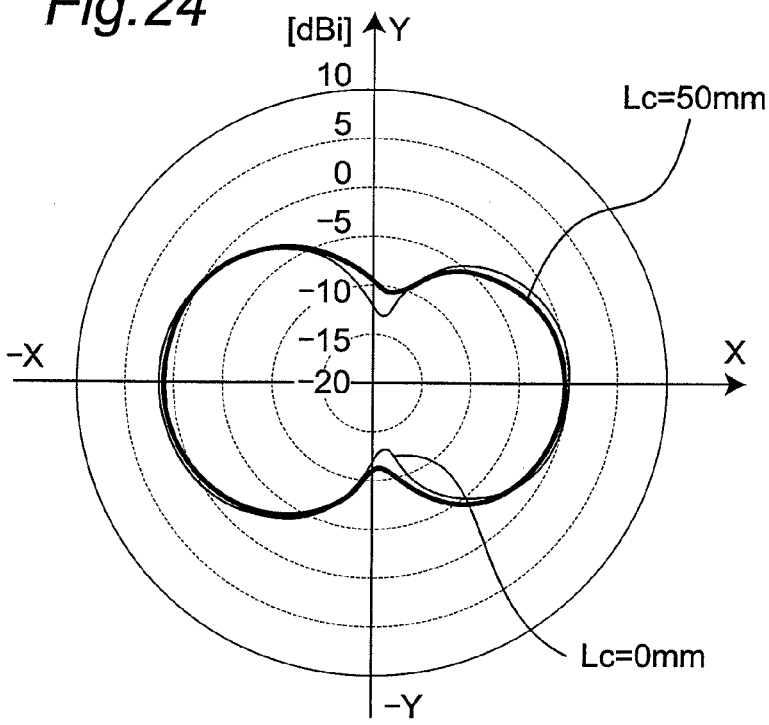
FIG. 24 is a radiation characteristic diagram for the second implementation example at an operating frequency of 3 GHz, in cases of Lc=0 mm and 50 mm.
Figure 25:
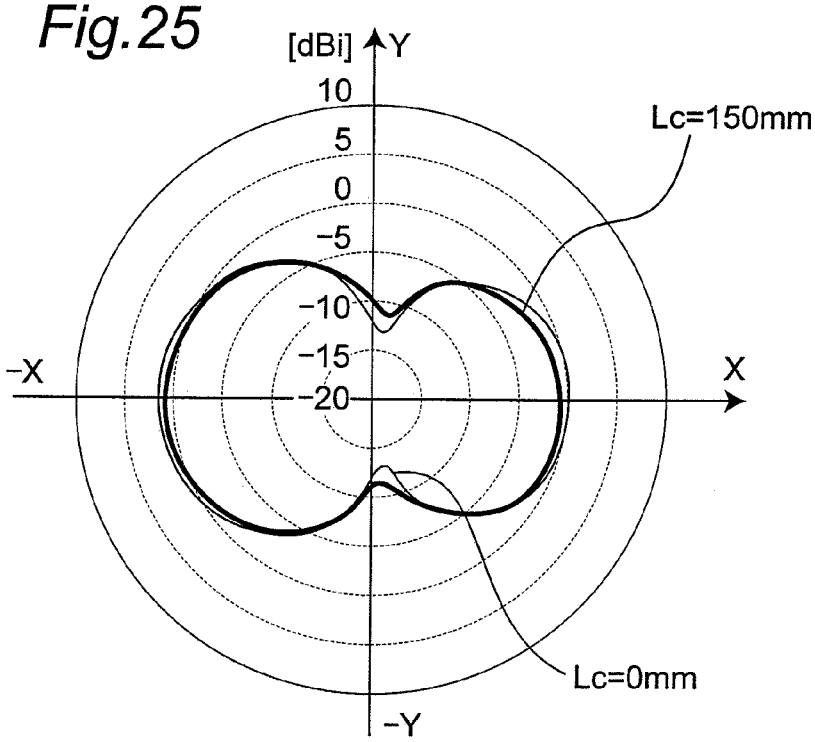
FIG. 25 is a radiation characteristic diagram for the second implementation example at an operating frequency of 3 GHz, in cases of Lc=0 mm and 150 mm.
Figure 26:
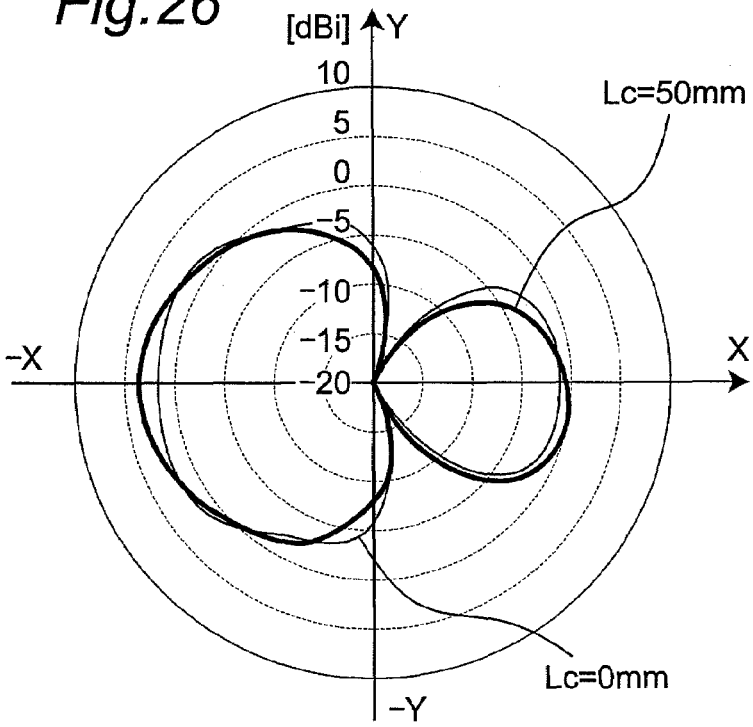
FIG. 26 is a radiation characteristic diagram for the second implementation example at an operating frequency of 6 GHz, in cases of Lc=0 mm and 50 mm.
Figure 27:
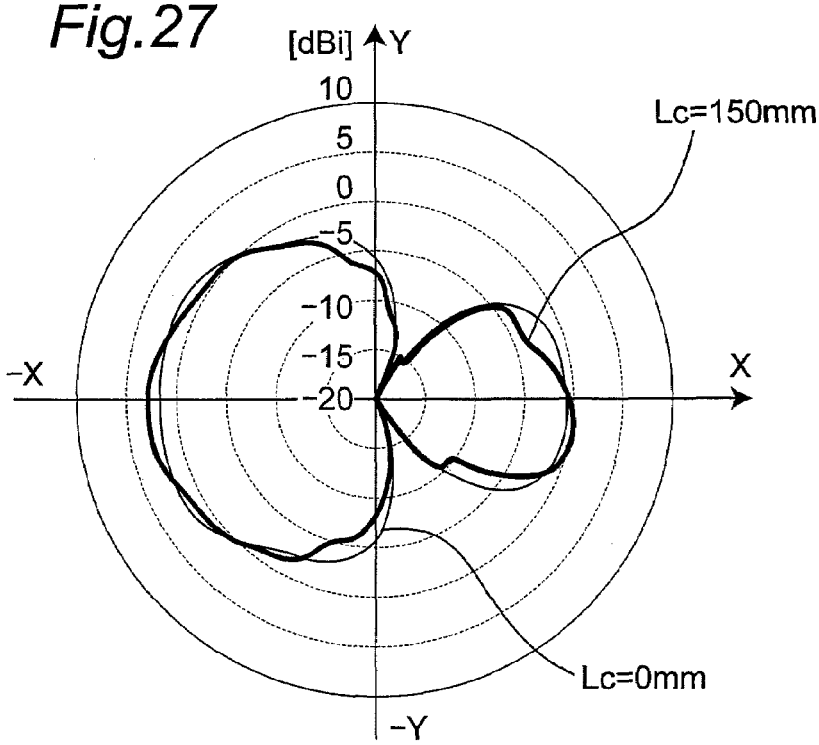
FIG. 27 is a radiation characteristic diagram for the second implementation example at an operating frequency of 6 GHz, in cases of Lc=0 mm and 150 mm.
Figure 28:
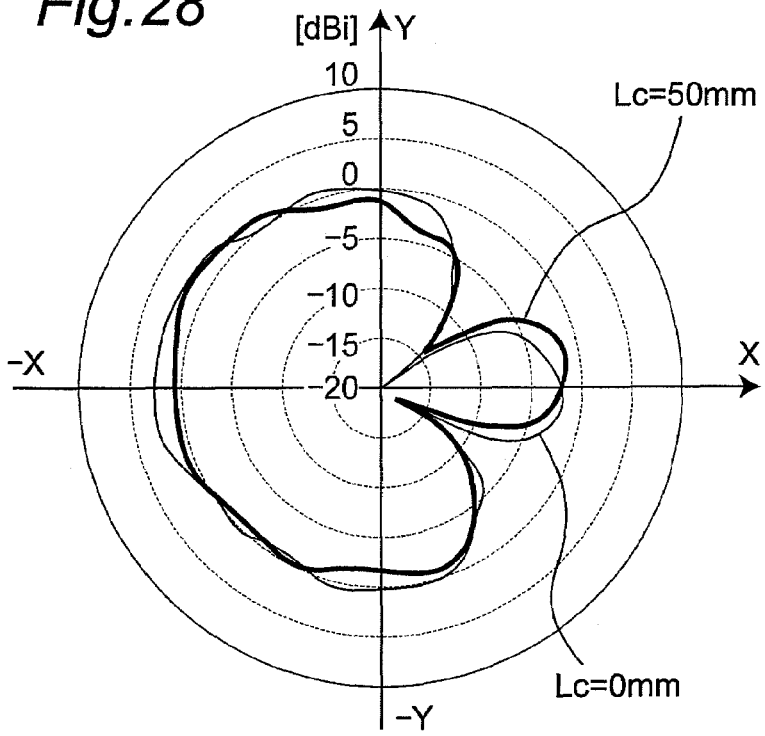
FIG. 28 is a radiation characteristic diagram for the second implementation example at an operating frequency of 9 GHz, in cases of Lc=0 mm and 50 mm.
Figure 29:
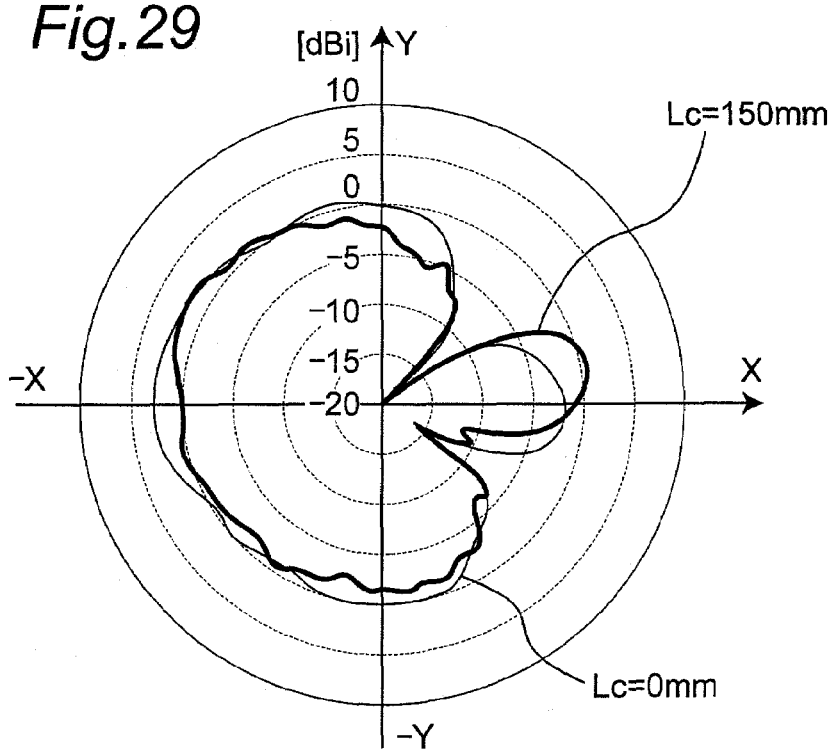
FIG. 29 is a radiation characteristic diagram for the second implementation example at an operating frequency of 9 GHz, in cases of Lc=0 mm and 150 mm.

FIGS. 24 to 29 are radiation characteristic diagrams according to the second implementation example. FIGS. 24 and 25 are radiation characteristic diagrams at an operating frequency of 3 GHz, in cases of Lc=0 mm, 50 mm, and 150 mm. FIGS. 26 and 27 are radiation characteristic diagrams at an operating frequency of 6 GHz, in cases of Lc=0 mm, 50 mm, and 150 mm. FIGS. 28 and 29 are radiation characteristic diagrams at an operating frequency of 9 GHz, in cases of Lc=0 mm, 50 mm, and 150 mm. Data indicated by thin lines in FIGS. 24 to 29 represents radiation characteristics in the comparative cases in which the length "Lc" of the copper wire 135 was zero. According to FIGS. 24 to 29, the second implementation example achieved stable radiation characteristics which was little affected by the length "Lc" of the copper wire 135, thus demonstrating that the object of the present invention was achieved. Similarly, the first implementation example also achieved stable radiation characteristics which was not affected by the length "Lc" of the copper wire 135. Further, in the first and second implementation examples, the same effect could be obtained across the entire operating band for all the radiation characteristics, including the radiation characteristics in the XZ-plane.

Figure 30:
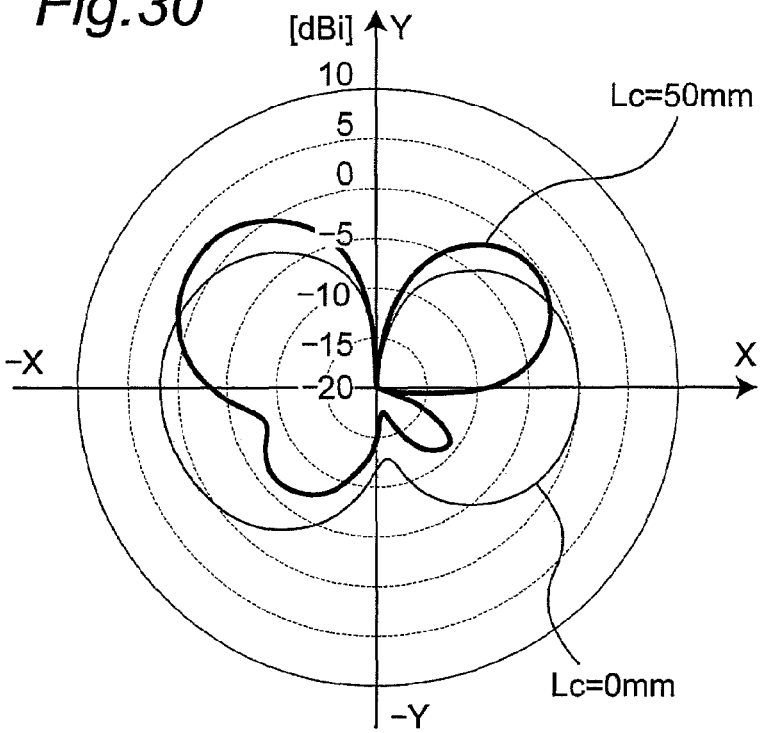
FIG. 30 is a radiation characteristic diagram for the first comparative example at an operating frequency of 3 GHz, in cases of Lc=0 mm and 50 mm.
Figure 31:
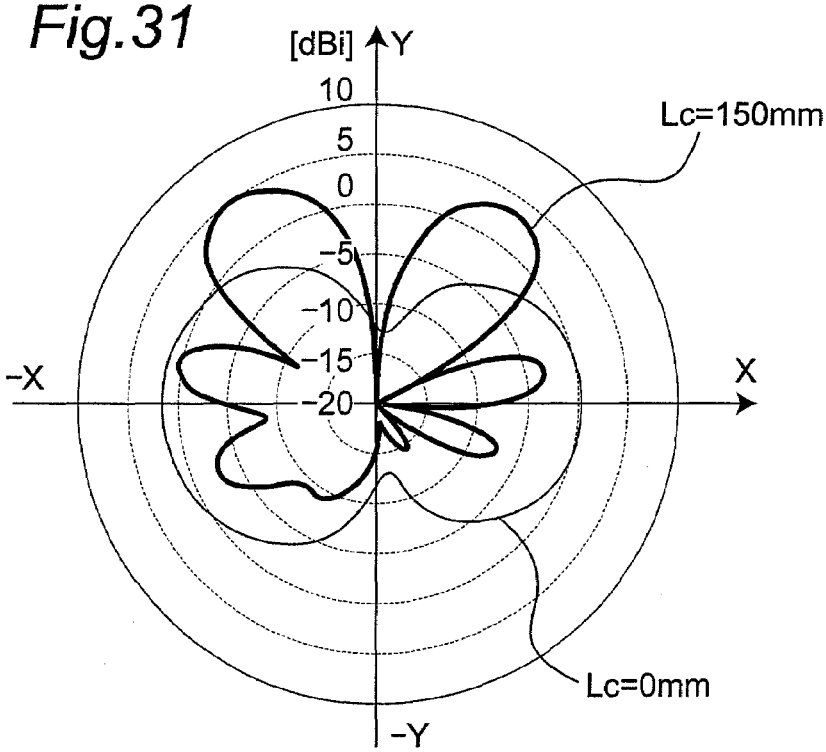
FIG. 31 is a radiation characteristic diagram for the first comparative example at an operating frequency of 3 GHz, in cases of Lc=0 mm and 150 mm.
Figure 32:
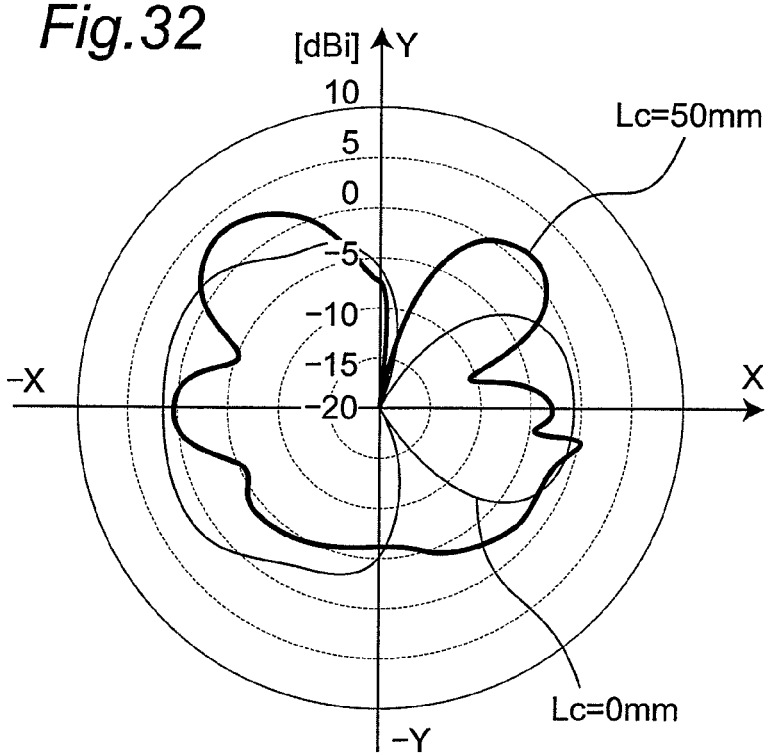
FIG. 32 is a radiation characteristic diagram for the first comparative example at an operating frequency of 6 GHz, in cases of Lc=0 mm and 50 mm.
Figure 33:
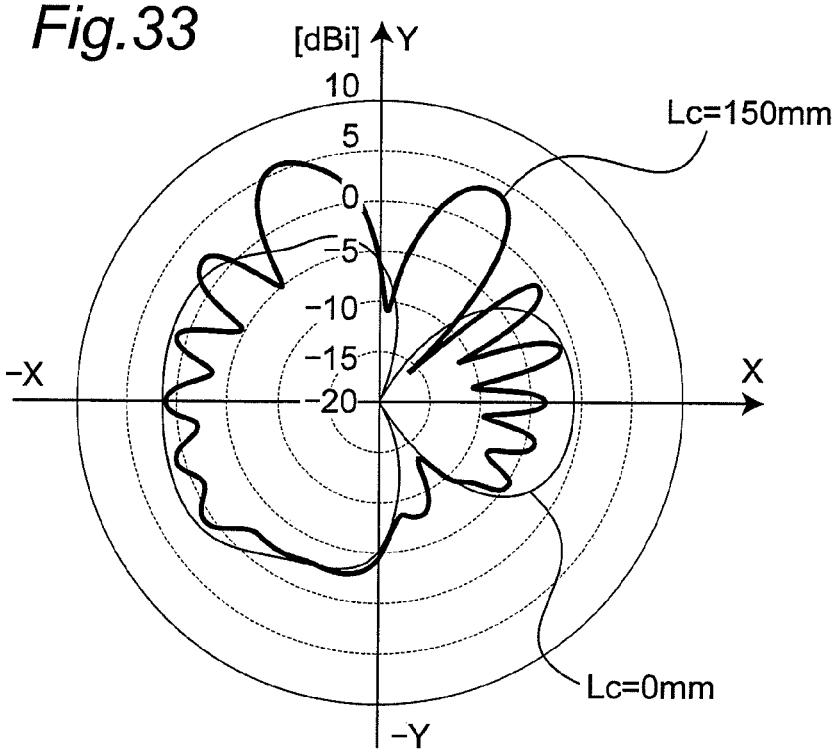
FIG. 33 is a radiation characteristic diagram for the first comparative example at an operating frequency of 6 GHz, in cases of Lc=0 mm and 150 mm.
Figure 34A:
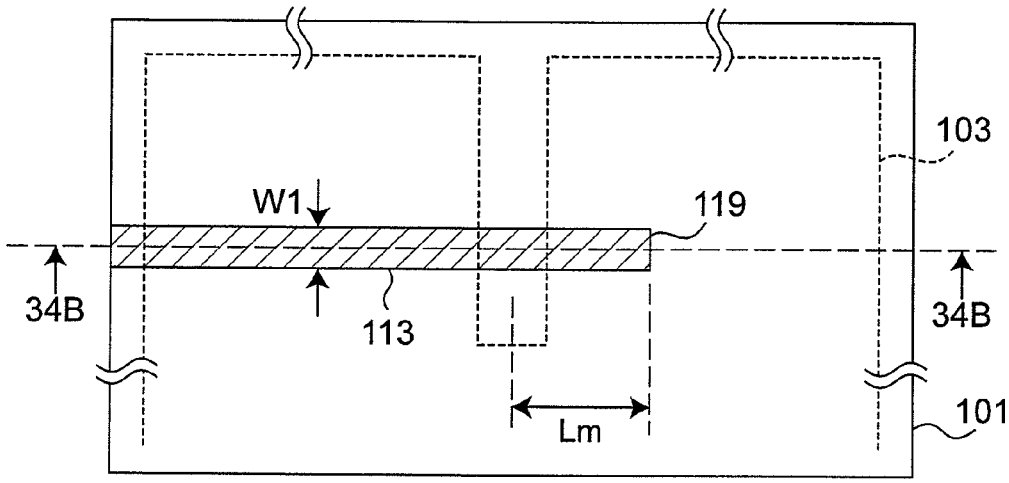
Fig.34A PRIOR ART
FIG. 34A is a schematic top view showing a structure of a typical one-quarter effective wavelength slot antenna (first prior art example)
Figure 34B:
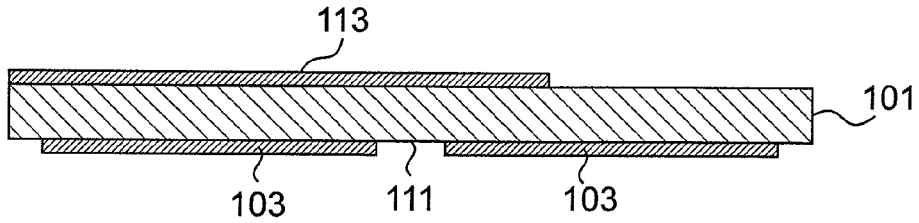
Fig.34B PRIOR ART
FIG. 34B is a schematic cross-sectional view of the slot antenna in FIG. 34A.
Figure 34C:
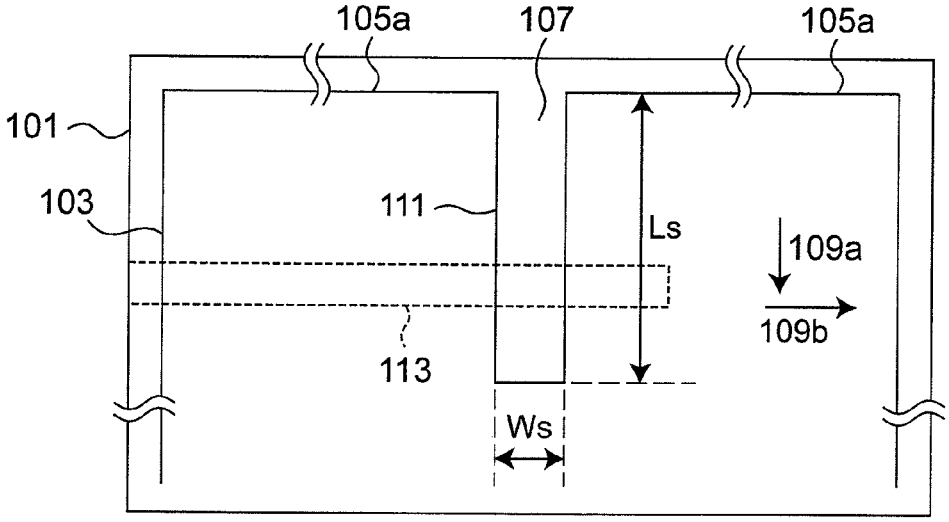
Fig.34C PRIOR ART
FIG. 34C is a schematic view showing a backside structure of the slot antenna in FIG. 34A in phantom view.
Figure 35A:
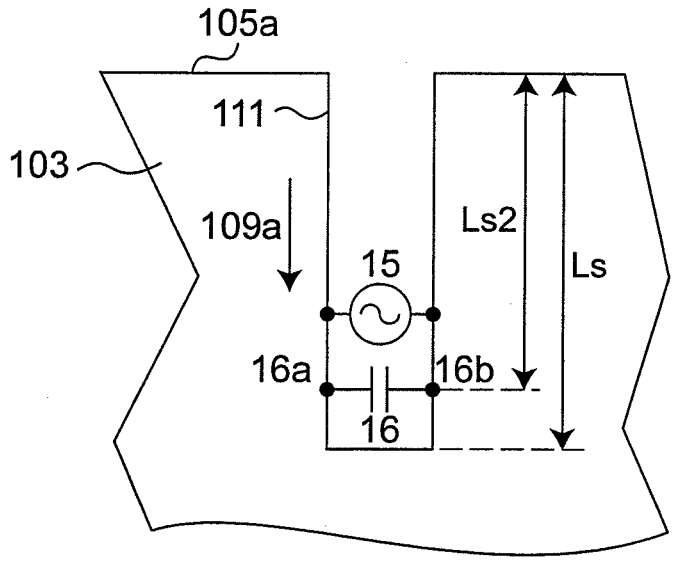
Fig.35A PRIOR ART
FIG. 35A is a schematic view showing a structure of a one-quarter effective wavelength slot antenna described in Patent Document 1 (second prior art example)
Figure 35B:
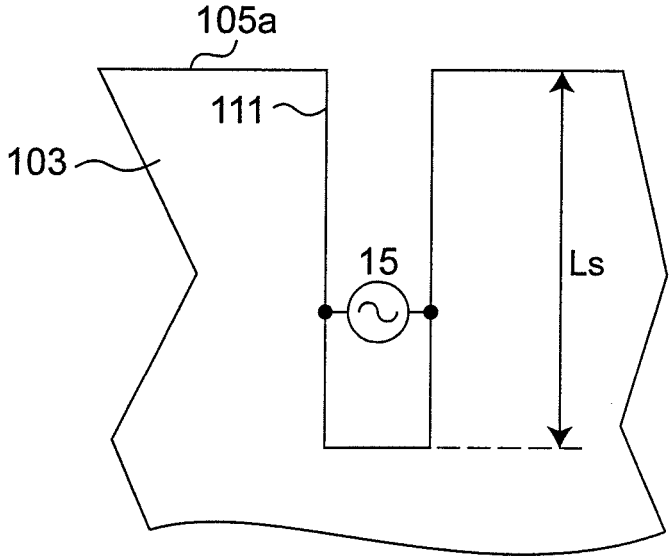
Fig.35B PRIOR ART
FIG. 35B is a schematic view showing the slot antenna in FIG. 35A when operating in a lower-frequency band.
Figure 35C:
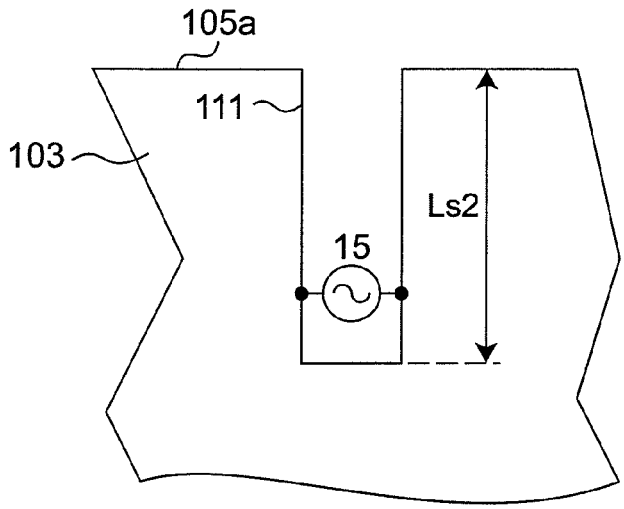
FIG. 35C is a schematic view showing the slot antenna in FIG. 35A when operating in a higher-frequency band.
Figure 36:
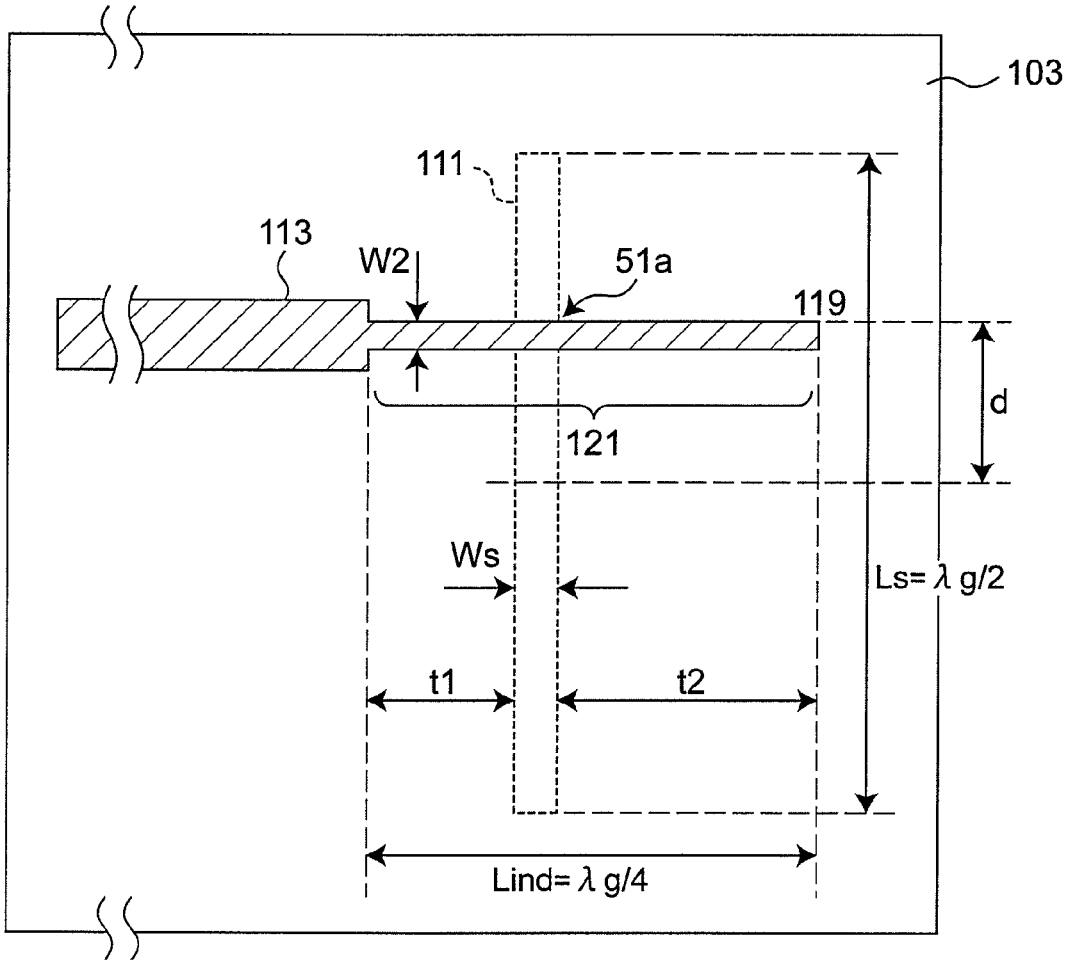
Fig.36 PRIOR ART
FIG. 36 is a schematic top view showing a structure of a slot antenna described in Non-Patent Document 1 (third prior art example)
Figure 37:
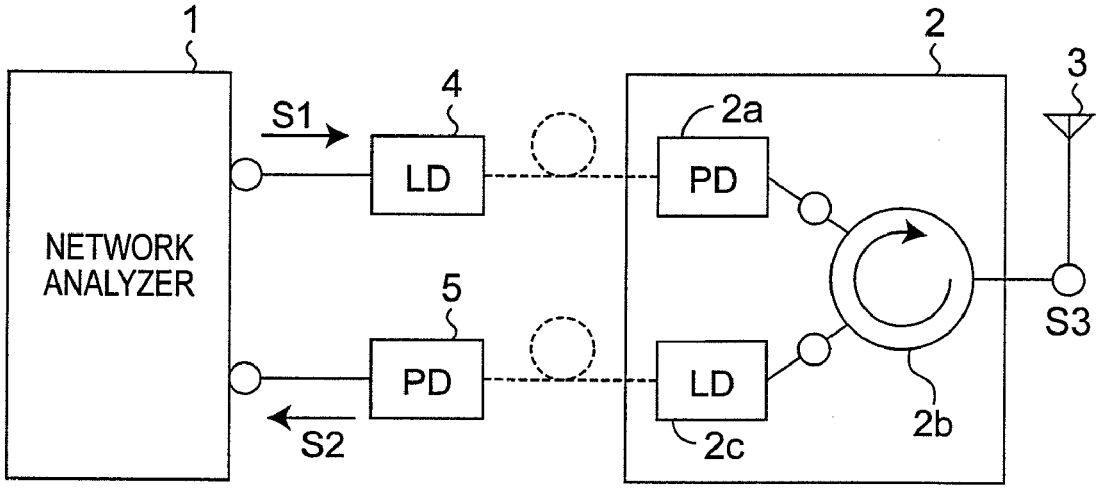
FIG. 37 is a schematic view showing a method for measuring a mobile phone antenna described in Non-Patent Document 2 (fourth prior art example).

Next, FIGS. 30 to 33 show radiation characteristic diagrams according to the first comparative example. FIGS. 30 and 31 are radiation characteristic diagrams at an operating frequency of 3 GHz, in cases of Lc=0 mm, 50 mm, and 150 mm. FIGS. 32 and 33 are radiation characteristic diagrams at an operating frequency of 6 GHz, in cases of Lc=0 mm, 50 mm, and 150 mm. Data indicated by thin lines in FIGS. 30 to 33 represents radiation characteristics in the comparative cases in which the length "Lc" of the copper wire 135 was zero. As is apparent from FIGS. 30 to 33, the comparative examples demonstrated a tendency that the radiation characteristics were strongly affected by the length "Lc" of the copper wire 135 of the external circuit at all frequencies. It is supposed that if an adverse effect of an unbalanced grounding conductor current could be avoided, which is the object of the present invention, then three radiation characteristics were identical to each other. However, resulting characteristics were completely different from each other depending on the length "Lc" of the copper wire 135.

As described above, according to the wideband slot antenna apparatuses according to the preferred embodiments of the present invention, it is possible to eliminate unstable radiation due to a grounding structure.

An wideband slot antenna apparatus according to the present invention can extend an impedance matching band without increasing an area occupied by circuitry and a manufacturing cost, and accordingly, it is possible to implement a high-functionality terminal with a simple configuration, which conventionally has not been able to be implemented unless multiple antennas are mounted. Further, the wideband slot antenna apparatus can contribute to implementation of a UWB system which uses a much wider frequency band than that of prior art apparatuses. In addition, since the operating band can be extended without using any chip component, the wideband slot antenna apparatus is also useful as an antenna tolerant to variations in manufacturing. Since the wideband slot antenna apparatus operates in the grounding conductor dipole antenna mode with the same polarization characteristics as the slot antenna mode, at frequencies lower than a frequency band of the slot antenna mode, the wideband slot antenna apparatus can be used as a small-sized wideband slot antenna apparatus. Further, in a system requiring ultra-wideband frequency characteristics, such as one that wirelessly transmits and receives a digital signal, the wideband slot antenna apparatus can be used as a small-sized antenna. In any case, when the wideband slot antenna apparatus is mounted on a terminal device, it is possible to provide good characteristics by which stable radiation can be maintained even when an unbalanced feed circuit is connected to the slot antenna apparatus.

As described above, although the present invention is described in detail with reference to preferred embodiments, the present invention is not limited to such embodiments. It will be obvious to those skilled in the art that numerous modified preferred embodiments and altered preferred embodiments are possible within the technical scope of the present invention as defined in the following appended claims.

What is claimed is:

1. A slot antenna apparatus comprising:

a grounding conductor, having an outer edge including a first portion facing a radiation direction, and a second portion other than the first portion;

a one-end-opened slot formed in the grounding conductor along the radiation direction such that an open end is provided at a center of the first portion of the outer edge of the grounding conductor;

a first feed line including a strip conductor close to the grounding conductor and intersecting with the slot at at least a part thereof to feed radio-frequency signals to the slot;

a second feed line including a strip conductor close to the grounding conductor and connected to an external circuit; and a signal processing circuit connected between the first and second feed lines, and connected to the grounding conductor, the signal processing circuit including active elements and processing radio-frequency signals to be transmitted and received, wherein the grounding conductor is configured to be symmetric about an axis parallel to the radiation direction and passing through the slot, and the grounding conductor is provided with a grounding terminal on the axis of symmetry of the grounding conductor, at the second portion of the outer edge of the grounding conductor, and the grounding terminal is to be connected to a ground of the external circuit, and wherein, as a result of providing the grounding terminal on the axis of symmetry of the grounding conductor, the grounding terminal has a higher input and output impedance than an impedance in an unbalanced mode of the grounding conductor.

2. The slot antenna apparatus as claimed in claim 1, wherein the first feed line is terminated at an open end, wherein a region of the first feed line, which extends from the open end over a length of one-quarter effective wavelength at a center frequency of the operating band, is configured as an inductive region with a characteristic impedance higher than 50Ω, and wherein the first feed line intersects with the slot at substantially a center of the inductive region.

3. The slot antenna apparatus as claimed in claim 1, wherein the first feed line is branched at a first point near the slot into a group of branch lines including at least two branch lines, and at least two branch lines among the group of branch lines are connected to each other at a second point near the slot and different from the first point, thereby forming at least one loop wiring line on the first feed line, wherein a maximum value of respective loop lengths of the at least one loop wiring line is set to a length less than one effective wavelength at an upper limit frequency of an operating band, wherein branch lengths of all of the branch lines terminated at an open end without forming a loop wiring line are less than one-quarter effective wavelength at the upper limit frequency of the operating band.

4. The slot antenna apparatus as claimed in claim 3, wherein each loop wiring line intersects with boundaries between the slot and the grounding conductor, and the slot is excited at two or more points at which the boundaries intersect with the loop wiring line and which have different distances from the open end of the slot.

5. The slot antenna apparatus as claimed in claim 1, wherein the grounding conductor is configured such that at the first portion of the outer edge of the grounding conductor, distances from the open end of the slot to both ends of the first portion of the outer edge are respectively set to a length greater than or equal to one-quarter effective wavelength at a resonant frequency of the slot, whereby the grounding conductor operates at a frequency lower than the resonant frequency of the slot.

* * * * *